US005707012A

United States Patent [19]

Maier et al.

[11] Patent Number: 5,707,012

[45] Date of Patent: Jan. 13, 1998

[54] ATOMIZING SIEVE AND FUEL INJECTION VALVE HAVING AN ATOMIZING SIEVE

[75] Inventors: Martin Maier, Möglingen; Jürgen Buchholz, Lauffen; Jörg Heyse, Markgröningen; Michael Klaski, Erdmannhausen; Edwin Liebemann, Bamberg; Klaus Wirth, Bischberg; Mathias Thomas, Appendorf; Klaus-Henning Krohn, Bamberg; Jutta Straetz, Ebelsbach; Stefan Lauter, Bamberg; Christof Dennerlein, Pettstadt; Anwar Abidin, Leonberg, all of Germany

[73] Assignee: Robert Bosch GmbH, Stuttgart, Germany

[21] Appl. No.: 505,295

[22] PCT Filed: Dec. 20, 1994

[86] PCT No.: PCT/DE94/01510

§ 371 Date: Sep. 29, 1995

§ 102(e) Date: Sep. 29, 1995

[87] PCT Pub. No.: WO95/17595

PCT Pub. Date: Jun. 29, 1995

[30] Foreign Application Priority Data

Dec. 21, 1993 [DE] Germany ..... 43 43 688.9
Nov. 29, 1994 [DE] Germany ..... 44 42 350.0

[51] Int. Cl.[6] ..... B05B 1/14; F02M 51/00; F02M 61/00

[52] U.S. Cl. ..... 239/575; 239/900; 239/DIG. 23; 239/585.4

[58] Field of Search ..... 239/590.3, 575, 239/585.1–585.5, 900, 432, DIG. 23, 533.12

[56] References Cited

U.S. PATENT DOCUMENTS

| | | | |
|---|---|---|---|
| 460,368 | 9/1891 | Splittstoser | 239/590.3 X |
| 2,541,854 | 2/1951 | Bachli et al. | 239/590.3 X |
| 2,618,511 | 11/1952 | Wahlin | 239/590.3 |
| 2,829,874 | 4/1958 | Freeman | 239/590.3 X |
| 2,929,567 | 3/1960 | Aghnides | 239/590.3 X |
| 4,057,190 | 11/1977 | Kiwior et al. . | |
| 4,646,974 | 3/1987 | Sofianek et al. | 239/590.3 X |
| 5,062,573 | 11/1991 | Makimura . | |
| 5,174,505 | 12/1992 | Shen . | |
| 5,423,489 | 6/1995 | Wood | 239/575 |
| 5,540,387 | 7/1996 | Reiter | 239/432 X |

FOREIGN PATENT DOCUMENTS

| | | |
|---|---|---|
| 0302660 | 2/1989 | European Pat. Off. . |
| 699734 | 4/1931 | France . |
| 828329 | 1/1952 | Germany . |
| 2306362 | 8/1974 | Germany . |
| 2723280 | 12/1977 | Germany . |
| 4013926 | 12/1990 | Germany . |
| 2190428 | 11/1987 | United Kingdom . |

*Primary Examiner*—Kevin Weldon
*Attorney, Agent, or Firm*—Kenyon & Kenyon

[57] ABSTRACT

An atomizing sieve of a fuel injection valve having a dish-like concavely cambered form is provided downstream of at least one spray orifice of the fuel injection valve, as seen in the direction of flow of fuel. The atomizing sieve is cast with an outer circumferential region in a protective cap provided at the downstream end of the fuel injection valve. For protection against mechanical effects, protective prongs of the protective cap project further downstream than the lowest region of the atomizing sieve. When the fuel is being injected, a part quantity collects in this lowest region and represents a comparatively static liquid quantity which new fuel then strikes. This arrangement allows an ideal break-up of the fuel into very small droplets. The atomizing sieve also forms a protective shield against icing-up, plugging and settlement of chemical substances within the fuel injection valve.

37 Claims, 25 Drawing Sheets

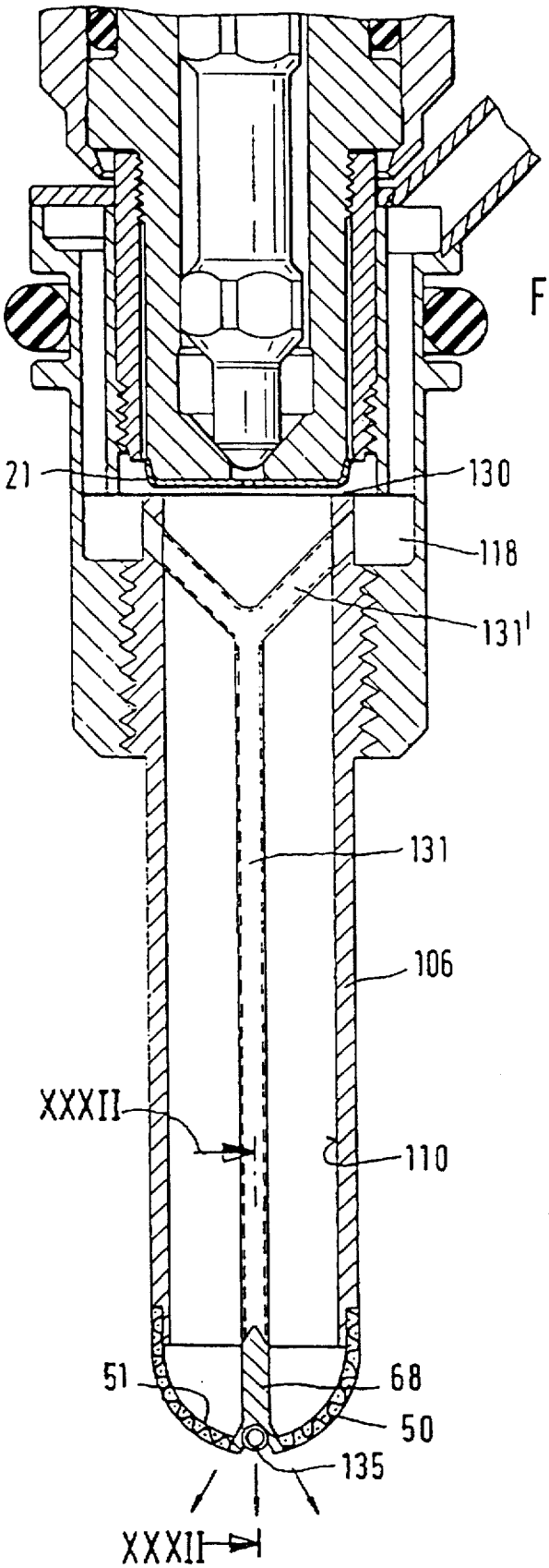
FIG. 31
FIG. 32
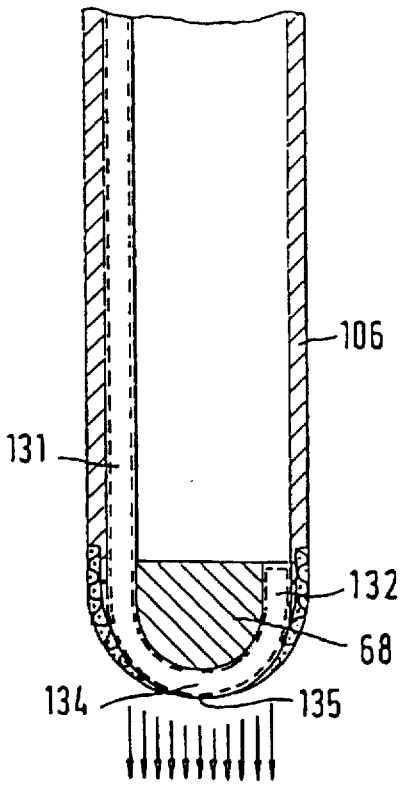

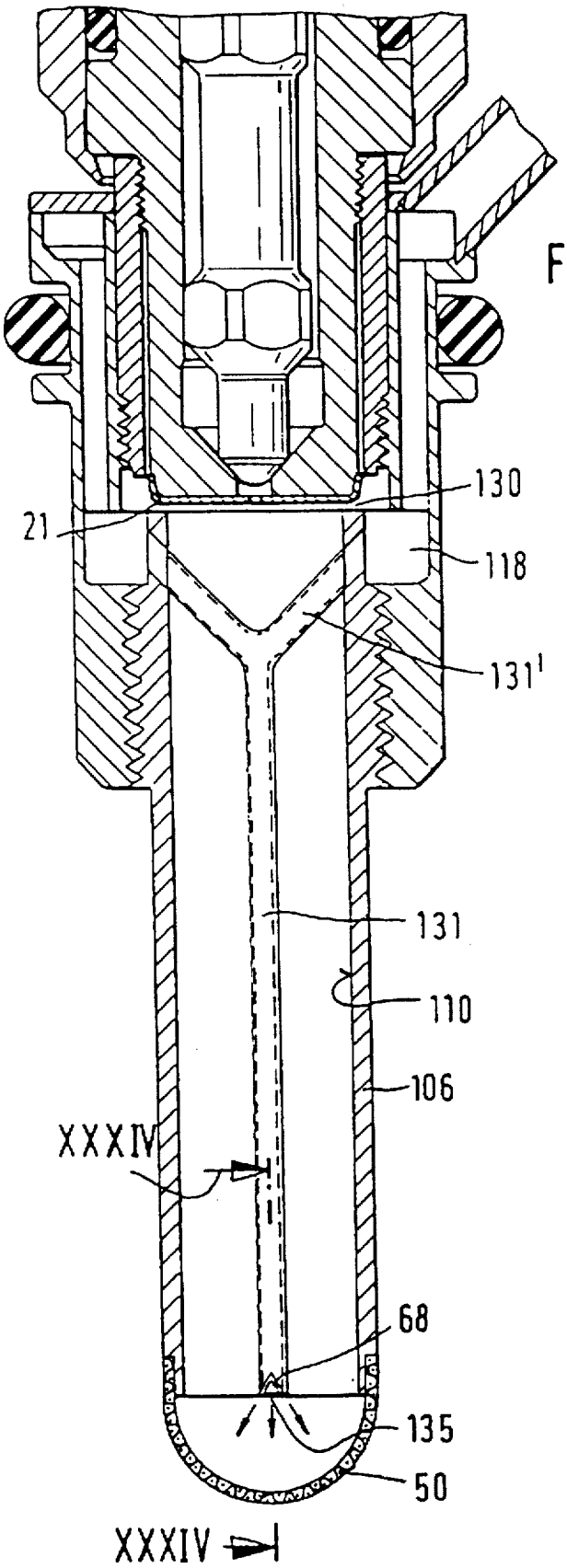
FIG. 33
FIG. 34
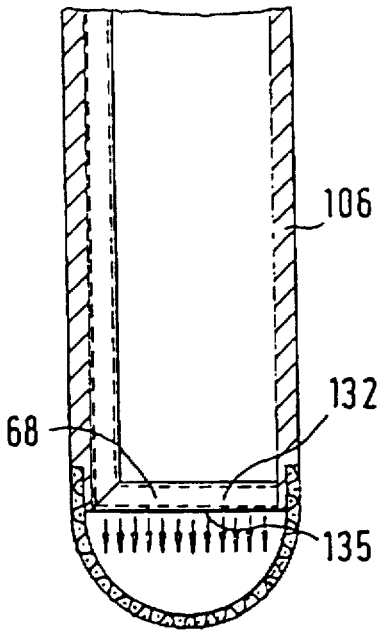

ATOMIZING SIEVE AND FUEL INJECTION VALVE HAVING AN ATOMIZING SIEVE

FIELD OF THE INVENTION

The present invention relates to an atomizing sieve and, more particularly, a fuel injection valve having an atomizing sieve.

BACKGROUND INFORMATION

German Patent Application No. 2 306 362 describes a device for fuel treatment for an internal combustion engine, in which fuel is metered by means of at least one injection valve and in turn, in a suction pipe located downstream of the injection valve or in a branch connection piece of the suction pipe, strikes a sieve arranged there. By means of this device, an easily ignitable fuel/air mixture is to be produced, particularly during the cold-starting and hot-running phases of the internal combustion engine, without the fuel quantity at the same time having to be appreciably increased. A good pre-evaporation of the fuel occurs if the sieve is designed so as to be electrically heatable. The great distance between the sieve and the injection valve does not allow any exactly focused jet forms, but on the contrary the fuel is sprayed widely.

Furthermore, European Patent Application No. 0 302 660 describes a fuel injection valve, at the downstream end of which is provided an adapter, into which passes fuel which comes from an outlet orifice and which in turn, at the downstream end of the adapter, strikes a plane meshed metal disc for the purpose of breaking up the fuel. The plane metal disc is arranged in such a way that an airstream, via holes in the adapter upstream of the metal disc and downstream of the metal disc ensures that fuel drops caught on the metal disc, are torn away. A better atomizing quality is therefore achieved only when the fuel is surrounded by an airstream near the metal disc, but an exact spray geometry cannot be achieved by means of this airstream.

Moreover, it is already known from German Patent Application No. 2 723 280 to design on a fuel injection valve, downstream of a metering orifice, a fuel break-up member in the form of a plane thin disc which has a plurality of curved narrow slits. The arcuate slits, made in the disc by etching, ensure by means of their geometry, that is to say by means of their radial width and their arc length, that a fuel film which breaks up into small droplets is formed. The etching operation for making the slits is highly cost-intensive. Furthermore, the individual slit groups have to be made very accurately, in order to achieve the break-up of the fuel in the desired way.

SUMMARY OF THE INVENTION

In contrast to this, the advantage of the atomizing sieve according to the present invention, having the is that, as a very simple component which can easily be mounted on fuel injection valves, it can be produced highly cost-effectively and quickly and reliably in a plurality of design versions and guarantees an outstanding atomization of the sprayed fuel.

It is particularly advantageous to make the atomizing sieve according to the present invention cambered in a dish-like manner. It is advantageous, moreover, to produce the atomizing sieve from a rust-proof metal, a plastic, TEFLON® or PTC, that is to say a material having a positive resistance/temperature coefficient. TEFLON® is suitable as a material for the atomizing sieve particularly when the atomizing sieve is to be used under extreme temperature conditions. Indeed, an atomizing sieve made of TEFLON® is hydrophobic and therefore prevents icing-up at temperatures down to −40°C.

An especially advantageous embodiment of the atomizing sieve, is obtained when a mesh width of around 0.2 mm of the sieve is provided. It may also be advantageous for special uses to make the meshes of the atomizing sieve two-layer or multi-layer in addition to a single-layer version, the plurality of fabric layers being offset relative to one another. The mesh density can be made variable in an advantageous way in order to adapt the atomizing quality of the area. The fabric of the atomizing sieve can have a constant mesh width, but can also become denser towards the outer zone of the sieve, or, conversely, can also be compacted towards the middle of the atomizing sieve.

It is advantageous, furthermore, to design the atomizing sieve as a bimetallic sieve, including two metals having different coefficients of thermal expansion, for example, by making the mesh orifices by means of a laser. The advantage of a bimetallic sieve is that the geometry of the sieve, that is to say, for example, the form of the camber, can be varied in a desired way in response to a differing operating temperature, in order to adapt the atomizing quality and the jet form to the requirements of the particular operating states.

Moreover, a heatable atomizing sieve for fuel evaporation is advantageous. Temperature-dependent sieve materials ensure that the resistance is variable. Thus, for example in the case of PTC materials having a positive resistance/temperature coefficient, the resistance increases under heating. A better evaporation of the fuel can thereby be achieved by means of electrical heating, particularly during a cold starting of the internal combustion engine.

A further advantage according to the present invention is a peripheral clamping ring which limits the atomizing sieve in the circumferential direction and in which the sieve leaf is clamped, gripped or cast round. This clamping ring allows a very simple mounting of the atomizing sieve on a fuel injection valve which can take place in one process step by gripping.

The advantage of the fuel injection valve according to the present invention is that, at a very low cost outlay, an atomizing sieve can be mounted in a very simple way on the fuel injection valve and contribute to a further improvement in the atomizing quality, even without being surrounded by gas, since the fuel striking the atomizing sieve is atomized especially finely into very small droplets at the meshes of the atomizing sieve, with the result that the exhaust-gas emission of an internal combustion engine is further reduced and a reduction in fuel consumption is also achieved. The fuel, by its impact on the atomizing sieve, is braked to an extreme degree and is deflected into the respective meshes. The collision ensures that the fuel is broken up or disintegrated. Thus, in the region of the atomizing sieve, an energy conversion of the kinetic energy stored in the fuel takes place. Vibrations and turbulences occur in the now finely broken-up fuel as a result of the collision. A precondition to this is at least one high-momentum fuel jet which, for example, can emerge from a nozzle orifice or from a plurality of spray orifices of a perforated spray disc. The breaking-up of the fuel on the atomizing sieve and the passage of the fuel through the fine meshes of the atomizing sieve give rise to a fine droplet mist downstream of the atomizing sieve. The fuel droplets now have a substantially larger surface than the fuel jets before these strike the atomizing sieve, and this in turn is an indication of good atomization.

In addition to optimized atomization and an associated reduction in the exhaust-gas emission and in the fuel consumption of the internal combustion engine, further advantages and positive effects emerge from the atomizing sieve according to the present invention. Thus, the atomizing sieve affords, downstream of the nozzle orifice or the perforated spray disc, increased safety against icing-up inside the fuel injection valve, particularly inside the perforated spray disc. By means of a fuel injection valve according to the present invention, a spraying of fuel can take place even at substantially lower temperatures (also with high air humidity) than is the case in fuel injection valves without an atomizing sieve. The atomizing sieve acts as an "ice trap". Moreover, the risk of so-called plugging on the perforated spray disc is considerably reduced by means of the atomizing sieve on the fuel injection valve. Indeed, poor-quality fuel possesses, inter alia, low-volatile constituents which, in known fuel injection valves, lead, when in contact with the suction-pipe atmosphere, to tar residues on the fuel injection valve. The consequences are reductions in cross section of the fuel outlet orifices, which can even lead to clogging. This adverse occurrence is ruled out with the downstream arrangement of the atomizing sieve according to the present invention, since the suction-pipe atmosphere is kept away from the fuel outlet orifices and therefore these constituents of the fuel already settle on the atomizing sieve. A possibly clogged atomizing sieve can be exchanged in a very simple way. In addition to the prevention of plugging, a settlement of lead sulfate on the nozzle orifice or the perforated spray disc is also avoided. Indeed, sulfurous fuels have the disadvantage that, when they strike colder components, sulfur condenses, the result of this being that layers of lead sulfate settle on metallic components. In a similar way to plugging, these layers cause a clogging of orifices on the fuel injection valve, for example the spray orifices of the perforated spray disc. The atomizing sieve according to the present invention effectively guarantees that no layers of lead sulfate are formed upstream of the atomizing sieve inside the fuel injection valve, since the chemical suction-pipe atmosphere does not take effect there.

The atomizing sieve fastened to the fuel injection valve is thus both improves the atomization of the fuel emerging from the fuel injection valve and protects against numerous influences of a mechanical and chemical nature.

It is especially advantageous to make the atomizing sieve according to the present invention cambered in a dish-like manner concavely, as seen in the direction of flow of the fuel. The concave camber of the atomizing sieve ensures that some of the precipitated fuel can converge in at least one lowest region. The collected fuel for a short time constitutes a comparatively static liquid quantity which new fuel then strikes. This embodiment of the present invention contributes to an especially high atomizing quality. Moreover, in this way, no fuel can collect at the outer sieve edge.

It is advantageous, furthermore, if the atomizing sieve is cast by means of an outer circumferential region into a protective cap. At the same time, the atomizing sieve is embedded into the protective cap by means of an amount of setback, that is to say, the downstream cap end of the protective cap limits the fuel injection valve downstream, while the lowest region of the atomizing sieve is located further upstream and therefore does not project from the fuel injection valve. This spatial arrangement affords sufficient protection against mechanical damage. For this purpose, the protective cap is designed in an advantageous way as a protective crown, thereby affording advantages in the dripping behavior of the fuel injection valve in relation to a protective cap having a peripheral protective ring.

The formation of a plurality of cambers on the atomizing sieve of the present invention affords further advantages, since very definite jet geometries or jet patterns can be generated for different instances of use. The jet angles of the fuel which are predetermined by the arrangement or inclination of the spray holes are maintained in an advantageous way, even when an atomizing sieve is located downstream. A two-jet arrangement, for example predetermined by the spray orifices, is not adversely influenced by the atomizing sieve, but can be reinforced by jet dividers arranged upstream or downstream of the atomizing sieve.

A surrounding of the fuel by gas, in addition to the atomizing sieve, is especially advantageous. The gas supply can be arranged in such a way that the gas is directed onto the fuel both upstream and downstream of the atomizing sieve. Ideally, the gas supply ducts are made in the protective cap downstream of the atomizing sieve and are oriented in such a way that, with their imaginary extensions, they touch the camber of the atomizing sieve tangentially downstream. The treatment quality is further increased by the surrounding by gas. In addition to the improvement in fuel atomization by means of a downstream gas supply, the advantage of very low costs results, since the supply ducts can be made in the protective cap in a very simple way and an annular gas gap, which is difficult to set with respect to the accuracy of the gas quantity, can be dispensed with. Desired fuel jet angles are largely maintained, despite the surrounding by gas, since the fuel is not surrounded completely over its circumference by gas emerging from the supply ducts.

The very simple and good handling is of great advantage, since the atomizing sieve forms, together with the protective cap, a treatment attachment which can be attached onto the most diverse types of valves and which can consequently also be used independently of forms of valve closing members.

It is particularly advantageous to arrange the atomizing sieve downstream at a clear spatial distance from the at least one spray orifice of the injection valve. The aim is, in particular, by means of an atomizer attachment including a spacer body and the atomizing sieve, with the injection valve being in a fixed installation position, to place the point of fuel atomization into the ideal position in the airflow of the suction pipe of the internal combustion engine and therefore to reduce or prevent the formation of a wall film of fuel in the suction pipe, with the result that a clear reduction in the exhaust-gas emission, especially in the fraction of HC, is consequently achieved. The spacer body, together with the atomizing sieve fastened in an advantageous way at its downstream end, thus ensures a spatial separation of the metering and treatment of the fuel. 5–50 mm (without gas) and 5–100 mm (with gas) have proved to be ideal distances between the spray orifice and the atomizing sieve. Ideally, the dimensions (diameter, length) of the spacer body, best made sleeve-shaped, can be varied in a simple way and adapted to suction pipes of different shapes in such a way that the atomization and treatment of the fuel can, for example, always take place in the central flow of the suction pipe, as a result of which the already mentioned formation of a wall film in the suction pipe is largely avoided.

In order to prevent a disturbing wetting of the inner wall of the spacer body, the injection valve must spray a fuel jet with as small an opening angle as possible, that is to say a so-called pencil-shaped jet. It is advantageous if there are therefore provided in the spacer body, near the spray orifice, orifices through which gas is introduced, in order to leave the fuel jet pencil-shaped over the length of the spacer body. Indeed, on the principle of the water-jet pump, for example suction-pipe air is sucked in through the orifices as a result of the fuel jet. The sucked-in air encases the pencil-shaped fuel jet, so that an adverse wetting of the inner wall of the spacer body is avoided. The afterdripping of fuel when the injection valve is switched off can be largely prevented by this measure. Moreover, a gas flow generated by an additional introduction of the gas also ensures improved discharge behavior of the fine fuel droplets.

In an advantageous way, by a combination of atomizing sieves of different shapes and of spacer bodies having different dimensions, together with or without an introduction of gas, with or without a surrounding by gas at the atomizing sieve and with or without jet dividers which can be located upstream or downstream of the atomizing sieve, it is possible to provide a large number of atomizer arrangements which are in each case coordinated with the actual conditions of the suction pipe and of the internal combustion engine. By means of these atomizer attachments on the injection valves, special forms of fuel injection (for example, elliptic jet patterns), asymmetric quantity distribution, injection at a plurality of inlet valves) can also be achieved in a very simple way.

BRIEF DESCRIPTION OF THE DRAWINGS

FIG. 31 shows a fourth example of a spacer body attached to a fuel injection valve having an atomizing sieve according to the present invention.

FIG. 32 shows a section along line XXXII—XXXII shown in FIG. 31.

FIG. 33 shows a fifth example of a spacer body attached to a fuel injection valve having an atomizing sieve according to the present invention.

FIG. 34 shows a section along line XXXIV—XXXIV shown in FIG. 33.

DETAILED DESCRIPTION OF THE INVENTION

Figure 1:
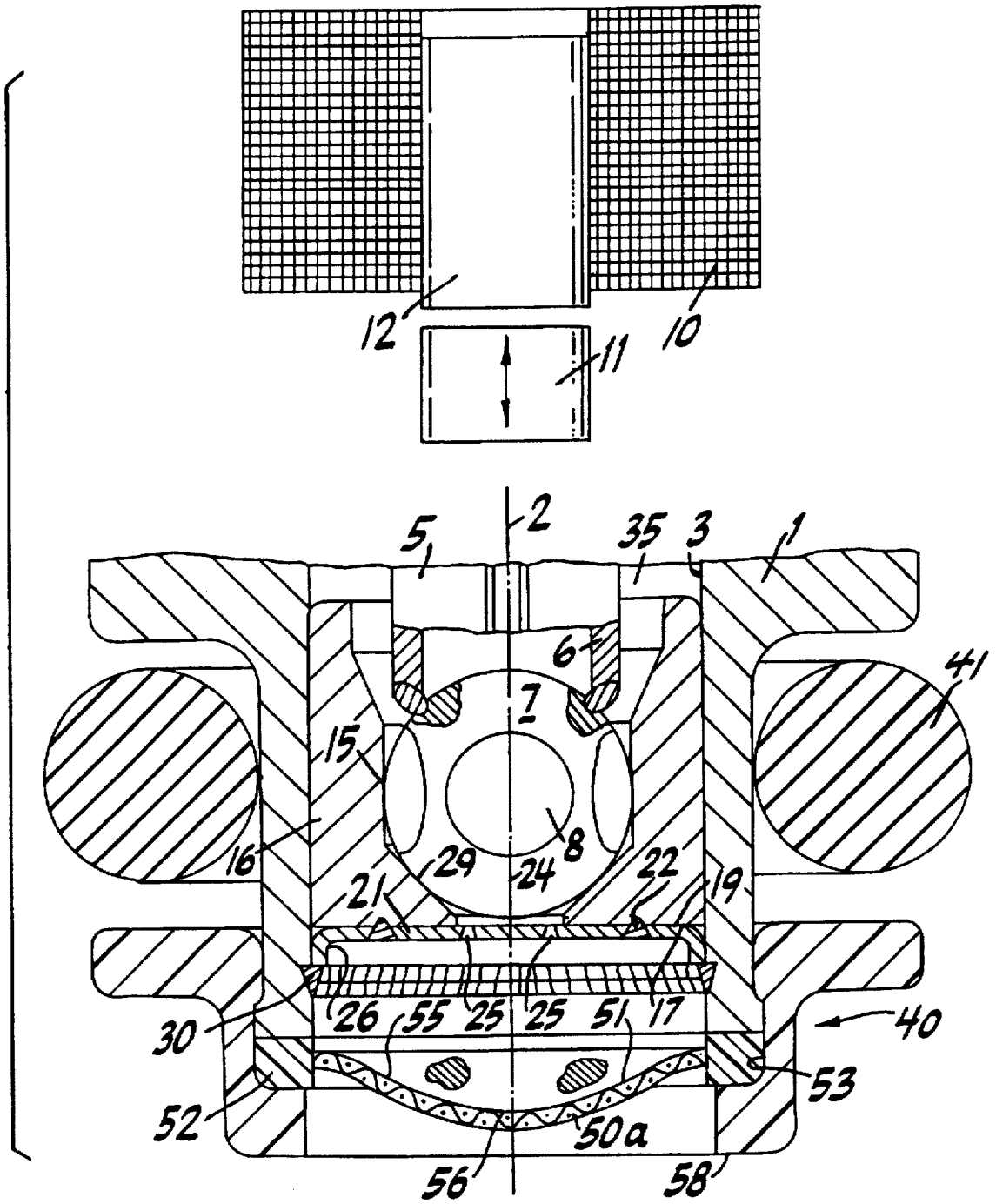
FIG. 1 shows a first exemplary embodiment of a fuel injection valve with an atomizing sieve according to the present invention.

FIG. 1 partially illustrates, as a first exemplary embodiment, a valve in the form of an injection valve for fuel injection systems of mixture-compressing spark-ignition internal combustion engines having an atomizing sieve according to the present invention. The injection valve has a tubular valve seat carrier 1, in which a longitudinal orifice 3 is made concentrically to a valve longitudinal axis 2. Arranged in the longitudinal orifice 3 is a, for example, tubular valve needle 5 which is connected at its downstream end 6 to a, for example, spherical valve closing body 7, on the circumference of which are provided, for example, five flattenings 8.

The actuation of the injection valve takes place in a known way, for example electromagnetically. For the axial movement of the valve needle 5 and therefore for opening the injection valve counter to the spring force of a return spring (not shown) and for the closing of the injection valve, there is an electromagnetic circuit, merely indicated, with a magnetic coil 10, an armature 11 and a core 12. The armature 11 is connected to the valve needle 5 and is aligned with the core 12. The magnetic coil 10 surrounds the core 12 which constitutes the end of an inlet connection piece not shown in more detail and serving for the supply of fuel.

A guide orifice 15 of a valve seat body 16 serves for guiding the valve closing body 7 during the axial movement. The cylindrical valve seat body 16 is sealingly fitted by welding into the downstream end of the valve seat carrier 1 facing away from the core 11, in the longitudinal orifice 3 extending concentrically to the valve longitudinal axis 2. On one lower end face 17 facing away from the valve closing body 7, the valve seat body 16 is concentrically and fixedly connected to a, for example, pot-shaped perforated spray disc 21, for example by means of a first weld seam 22 formed by means of a laser, so that the perforated spray disc 21 bears with its upper end face 19 on the lower end face 17 of the valve seat body 16. Located in the central region 24 of the perforated spray disc 21 is at least one, for example four spray orifices 25 shaped by erosion or punching.

A peripheral holding edge 26 of the perforated spray disc 21, which extends away from the valve seat body 16 in the axial direction, is curved conically outwards as far as its end. Radial pressure therefore prevails only between the longitudinal orifice 3 and the slightly conically outward-curved holding edge 26 of the perforated spray disc 21. At its end, the holding edge 26 of the perforated spray disc 21 is connected to the wall of the longitudinal orifice 23, for example by a peripheral sealing second weld seam 30 formed, for example, by means of a laser.

The depth of penetration of the valve seat part including the valve seat body 16 and the potshaped perforated spray disc 21 into the longitudinal orifice 3 determines the presetting of the stroke of the valve needle 5, since one end position of the valve needle 5, with the magnetic coil 10 not energized, is fixed by the bearing of the valve closing body 7 on a valve seat face 29 of the valve seat body 16. The other end position of the valve needle 5, with a magnetic coil 10 energized, is fixed, for example, by the bearing of the armature 11 on the core 12. The travel between these two end positions of the valve needle 5 thus constitutes the stroke.

The spherical valve closing body 7 cooperates with the valve seat face 29 of the valve seat body 16, said valve seat face 29 tapering frustoconically in the direction of flow and being formed in the axial direction between the guide orifice 15 and the lower end face 17 of the valve seat body 16. From a valve inner space 35 limited in the radial direction by the longitudinal orifice 3 of the valve seat carrier 1, the fuel enters the valve seat body 16 and flows along in the guide orifice 15 as far as the valve seat face 29. So that the flow of fuel also reaches the spray orifices 25 of the perforated spray disc 21, for example five flattenings 8 are made on the circumference of the spherical valve closing body. The five circular flattenings 8 make it possible, when the injection valve is in the opened state, for the fuel to flow through the valve inner space 35 as far as the spray orifices 25 of the perforated spray disc 21.

On the circumference of the valve seat carrier 1, a protective cap 40 is arranged at its downstream end facing away from the magnetic coil 10 and is connected to the valve seat carrier 1, for example by means of a snap connection. A sealing ring 41 serves for sealing off between the circumference of the injection valve and a valve receptacle not shown, for example the suction conduit of the internal combustion engine.

Arranged downstream of the perforated spray disc 21 is an atomizing sieve **50*a* according to the persent invention which, for example, is cambered in a dish-like manner, a camber 51 being provided concavely, as seen in the direction of flow of the fuel. The atomizing sieve 50*a*, preferably produced from a rust-proof metal, is limited in the circumferential direction by a peripheral clamping ring 52, in which the metallic fabric of the atomizing sieve 50*a*** is clamped, gripped or cast round.

The clamping ring 52 allows a very simple mounting of the atomizing sieve **50*a*, so that the entire sieve arrangement including the atomizing sieve 50*a* and the clamping ring 52 can be gripped between the valve seat carrier 1 and the protective cap 40 in one process step. For this purpose, either the atomizing sieve 50*a* together with the clamping ring 52 can be pressed by means of a tool against the downstream end of the valve seat carrier 1 and the protective cap 40 being pushed over the clamping ring 52 onto the valve seat carrier 1, until the snap connection between the protective cap 40 and valve seat carrier 1 is made, or the atomizing sieve 50*a* together with the clamping ring 52 can be inserted directly into an inner groove 53 of the protective cap 40 and fastened, together with the protective cap, to the valve seat carrier 1, and when the snap connection between the protective cap 40 and the valve seat carrier 1 is obtained, the clamping ring 52 is gripped completely between the downstream end of the valve seat carrier 1 and the protective cap 40**.

The fuel jets emerging from the at least one spray orifice 25 of the perforated spray disc 21, for example from four spray orifices 25, collide downstream of the perforated spray disc 21 with an inner sieve surface 55 of the cambered atomizing sieve **50*a*. The collision or impact of the fuel on the atomizing sieve 50*a* constitutes an especially effective type of treatment, in which atomization into particularly small droplets takes place. The result of the impact of the fuel on the inner sieve surface 55 is that the fuel is braked to an extreme degree and is deflected into respective nearby meshes of the atomizing sieve 50***a*. The collision with the atomizing sieve 50*a* already alone ensures that the fuel is broken up or disintegrated. An energy conversion of the kinetic energy stored in the fuel emerging in jet form from the spray orifices 25 of the perforated spray disc 21 takes place necessarily in the region of the atomizing sieve 50*a*, in that vibrations and turbulences now occur as a result of the collision in the finely broken-up fuel.

The aim of this type of treatment is to spray particularly finely atomized fuel in the form of very small droplets out of the injection valve, for example in order to achieve very low exhaust-gas emissions of the internal combustion engine and to reduce the fuel consumption. Precisely this requirement can be satisfied in a particularly advantageous way by means of the atomizing sieve 50*a*. Indeed, the breaking-up of the fuel at the atomizing sieve 50*a* and the passage of the fuel through the fine meshes of the atomizing sieve 50*a* give rise to a fine droplet mist downstream of the atomizing sieve 50*a*. These particularly small fuel droplets forming the droplet mist possess a substantially larger surface than the fuel jets before these strike the atomizing sieve 50*a*, and this is in turn an indication of good atomization. It can even be said that, as a result of the mesh form, countless "jet spikes", including, very fine droplets, are formed downstream of the atomizing sieve 50*a*. This mode of action just described also distinguishes all the exemplary embodiments according to the present invention listed below.

In the first exemplary embodiment according to the present invention, shown in FIG. 1, of the atomizing sieve 50*a* and of its arrangement on the injection valve, the atomizing sieve 50*a* is shaped concavely in the direction of flow of the fuel in the form of a dish or of a cup. This concave camber 51 of the atomizing sieve 50*a* ensures that some of the fuel can converge in the direction of a lowest region 56 of the cambered atomizing sieve 50*a*. The fuel collected in this middle lowest region 56 constitutes in each case for a short time a comparatively static liquid quantity which, when the armature 11 or the valve needle 5 is pulled up and the injection valve is thereby opened, new fuel emerging from the spray orifices 25 of the perforated spray disc 21 then strikes. Thus, while fuel is collected in the middle region 56 of the dish-like atomizing sieve 50*a* as a result of the camber 51, the atomizing sieve 50*a* is only continuously wetted in the regions directed towards the dish edge or towards the clamping ring 52. A particularly high atomizing quality is thus achieved as a result of the achievement directly at the meshes of the atomizing sieve 50*a* and by means of the fuel which strikes the static liquid quantity and by means of which treatment takes place in this middle region 56.

A minimum distance between the perforated spray disc 21 and the atomizing sieve 50*a* in the direction of the valve longitudinal axis 2 is especially important for the quality of the treatment or atomization of the fuel. If said distance falls short of this minimum value, it can happen that the volume formed between the perforated spray disc 21 and the atomizing sieve 50*a* is filled with too large a quantity of fuel and atomization takes place no longer or only poorly. In the first exemplary embodiment of the present invention, therefore, the atomizing sieve 50*a* is arranged in such a way that it is clamped between the protective cap 40 and valve seat carrier 1 only downstream of the valve seat carrier 1. In addition to the factor of the minimum distance between the perforated spray disc 21 and the atomizing sieve 50*a*, the mesh width of the atomizing sieve 50*a* also plays a decisive part which critically determines the spray quantity per unit time. Finally, the mesh width represents the size of each hole of the atomizing sieve 50*a*. Mesh widths from approximately 0.1 mm are expedient; however, the best atomization results are achieved with a mesh width of $\geqq 0.2$ mm.

In the arrangement according to FIG. 1, in which the atomizing sieve 50*a* together with its clamping ring 52 is gripped between the valve seat carrier 1 and protective cap 40, one cap end 58 of the protective cap 40 forms the downstream end of the entire injection valve. The atomizing sieve 50*a* is therefore not cambered to such an extent that it projects out of the injection valve downstream. Consequently, the atomizing sieve 50*a* cannot be destroyed by mechanical actions on the injection valve from outside. Instead, the atomizing sieve 50*a* itself forms a protective shield for the perforated spray disc 21. Indeed, by means of the atomizing sieve 50*a* located downstream of the perforated spray disc 21, the risk of icing-up, so-called plugging and settlements of lead sulfate on the perforated spray disc 21 is considerably reduced, since, as a result, the suction-pipe atmosphere is kept away from the spray orifices 25. These positive effects which can be achieved in addition to the optimum atomization have already been discussed in detail.

In the further exemplary embodiments of the present invention shown in the following figures, the parts remaining the same or having the same effect as those in the exemplary embodiment illustrated in FIG. 1 are identified by the same reference symbols. Although the atomizing sieves 50 are additionally identified by letters, all the further atomizing sieves 50 are distinguished by the mode of action already described with respect to the first exemplary embodiment. The different identification is intended merely to refer to different possibilities of constructive design.

Figure 2:
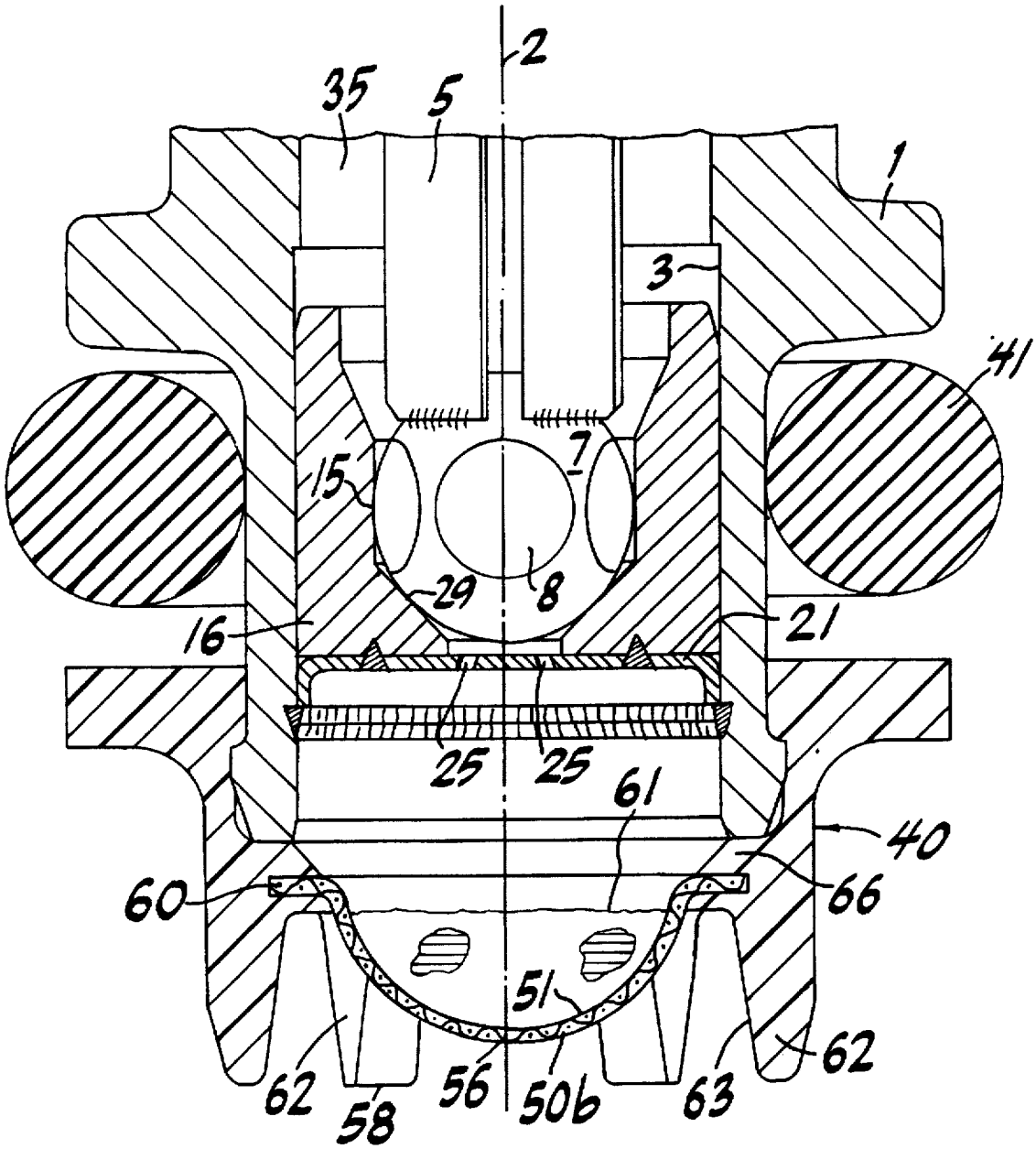
FIG. 2 shows a second exemplary embodiment of a fuel injection valve with an atomizing sieve according to the present invention.

The second exemplary embodiment illustrated in FIG. 2 differs mainly from the exemplary embodiment illustrated in FIG. 1 in the form of the protective cap 40 and in the fastening of the atomizing sieve 50*b* to the injection valve. The atomizing sieve 50*b* is likewise cambered in a dish-like manner concavely in the direction of flow and is produced, for example, from a rust-proof metal. The, for example, metallic fabric, which is angled in its outer radial circumferential region 60 in the manner of a plate rim, is cast exactly by means of this circumferential region 60 into the protective cap 40. Of course, when the circumferential region 60 of the atomizing sieve 50*b* is being cast into the protective cap 40, plastic residues also penetrate into the meshes of the atomizing sieve 50*b* directly outside the circumferential region 60, this being indicated by an uneven plastic edge 61 in the fabric of the atomizing sieve 50*b*.

The atomizing sieve 50*b* is embedded into the protective cap 40 by means of an amount of setback in a similar way to the atomizing sieve 50*a*, that is to say the cap end 58 of the protective cap 40 limits the injection valve downstream, while the lowest region 56 of the atomizing sieve 50*b* is located further upstream. This spatial arrangement affords sufficient protection against mechanical damage. The protective cap 40 is designed as a protective crown. Indeed, facing away from the valve closing body 7, for example, six protective prongs 62 form the downstream end of the injection valve in a similar way to a crown placed on the head. The number of protective prongs 62 can be made variable, that is to say, for example, with two, four or six protective prongs 62 on the protective cap 40.

The protective cap 40 in the form of a protective crown has advantages in terms of the dripping behavior of the injection valve in relation to a closed, that is to say, a continuous protective ring. The fuel swirls downstream of the atomizing sieve 50b are weaker, with the result that less fuel settles as a wall film on an inner wall 63 of the protective cap. The protective cap 40 which is wetted to only a slight extent markedly reduces the risk of the formation of drops. In principle, however, it is, of course, also possible to cast the atomizing sieve 50b into a protective cap 40 which has only a one-part continuous protective ring.

The atomizing sieve 50b, once again cambered outwards concavely in the direction of flow, ensures that the fuel flows into the sieve center, that is to say into the middle lowest region 56, and collects there for a short time. In this middle region 56, the fuel is treated the most effectively to form very fine droplets having a large surface. The result of a convex camber of the atomizing sieve 50 would be that a considerable wall film of fuel would occur on the inner wall 63 of the protective cap 40 since the fuel would flow radially outwards onto the protective cap 40.

The mesh width and camber radius of the atomizing sieve 50b can be varied according to desired characteristic data of the treated fuel. The production costs of the atomizing sieves 50 are comparatively low, so that various embodiments can also be produced without a high outlay. In the exemplary embodiment of the present invention shown in FIG. 2, it is also necessary to ensure that a minimum distance between the perforated spray disc 21 and atomizing sieve 50b is maintained, thereby providing a sufficiently large volume which cannot be filled completely with fuel during injection. The atomizing quality would be appreciably reduced if said distance were to fall short of the minimum value.

Figure 3:
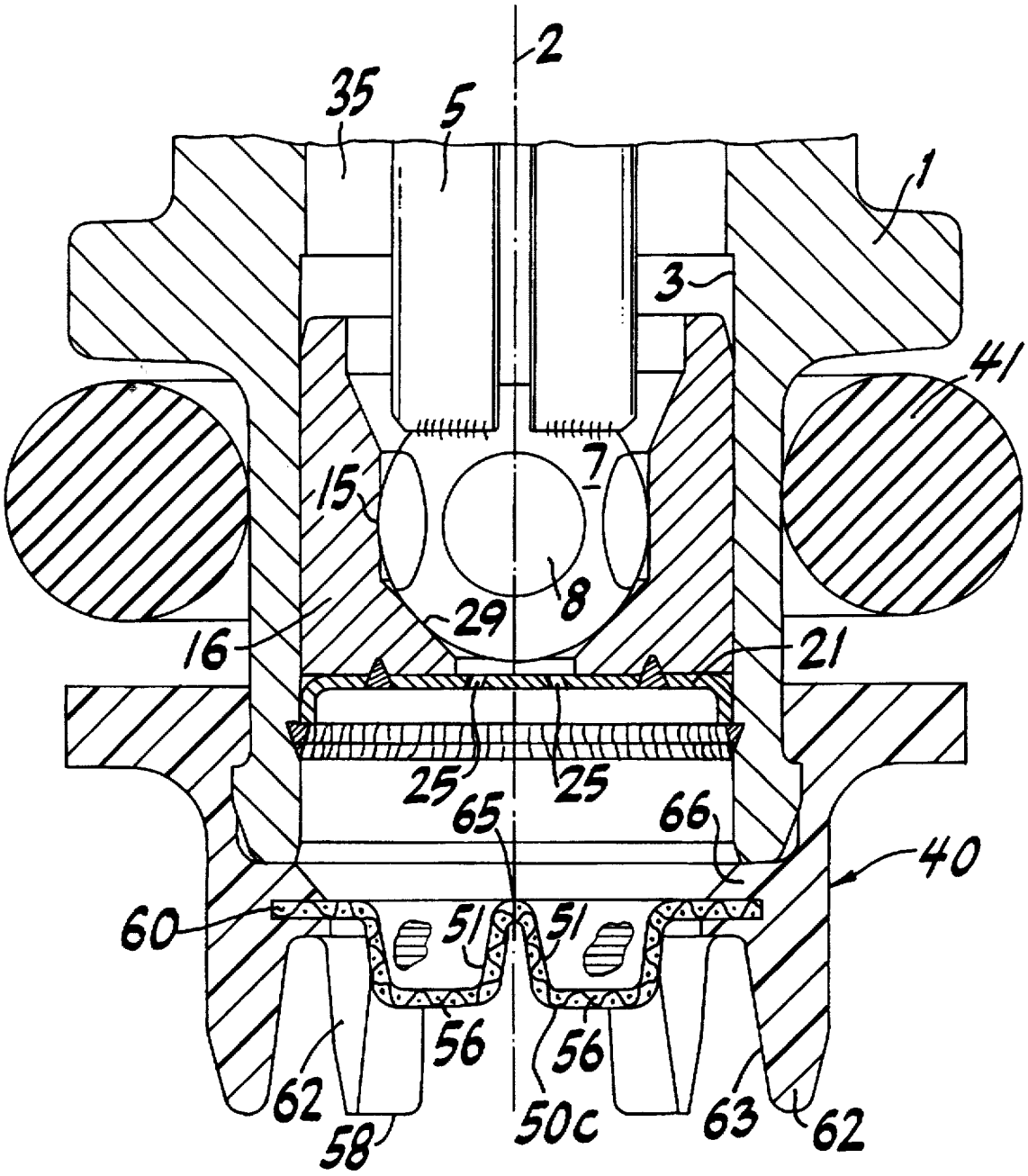
FIG. 3 shows a third exemplary embodiment of a fuel injection valve with an atomizing sieve according to the present invention.

FIG. 3 illustrates a third exemplary embodiment according to the present invention, in which the atomizing sieve 50c is cast as a double dish in the protective cap 40 downstream of the perforated spray disc 21. In this case, therefore, the atomizing sieve 50c possesses two cambers 51 made concave in the direction of flow of the fuel, although the cambers 51 do not necessarily need to have a constant radius. As shown in FIG. 3, the dish-like cambers 51 can also be made plane in their lowest regions 56. The embodiments of the cambers 51 of the atomizing sieve 50c are dependent on the tools for forming the sieve and can be influenced correspondingly by these tools.

Proceeding from a plane sieve leaf, for example the process for forming the atomizing sieve 50 takes place, to obtain an individual camber 51, in the same way as with the atomizing sieves 50a and 50b and, if a plurality of cambers 51 are desired, in the same way as with the atomizing sieve 50c and further following examples. The sieve leaf, plane in the initial state, is formed, for example by deep-drawing or stamping by means of dies, in such a way that the desired cambers 51 are obtained.

The forming capacity of the sieve fabric and the complexity and desired quality of the cambers 51 to be formed in the atomizing sieve 50 are critical for the choice of a specific deep-drawing alternative.

The two cambers 51 of the atomizing sieve 50c are shaped in such a way that, with a perforated spray disc 21 having four spray orifices 25, in each case the fuel from two spray orifices 25 enters a camber 51 in the double dish of the atomizing sieve 50c. The fuel is therefore atomized and treated in two jet halves on the atomizing sieve 50c. The cambers 51 can, for example, each be designed with a circular or elliptic plane lowest region 56 or with a continuous camber radius.

FIGS. 4 to 8 show basic diagrammatic sketches, not to scale, of atomizing sieves 50 according to the present invention having one or more sieve cambers and their relationship to the individual spray orifices 25 of a perforated spray disc 21 having four spray orifices 25. Thus, the spray orifices 25 of the perforated spray disc 21 are represented as spray orifices 25' projected onto the cambers 51 of the atomizing sieves 50, in order to illustrate the spraying of the fuel onto the atomizing sieves 50.

Figure 4:
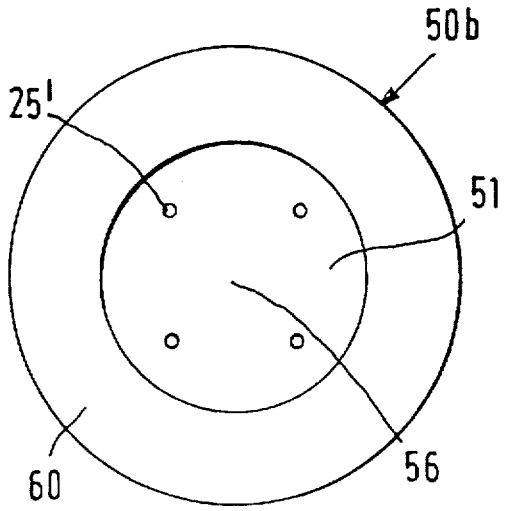
FIG. 4 shows a basic diagrammatic sketch of an atomizing sieve with a camber according to the present invention.
Figure 5:
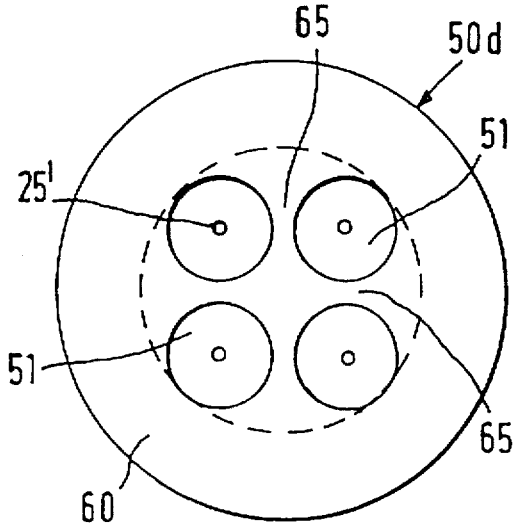
FIG. 5 shows a basic diagrammatic sketch of an atomizing sieve with four cambers according to the present invention.
Figure 6:
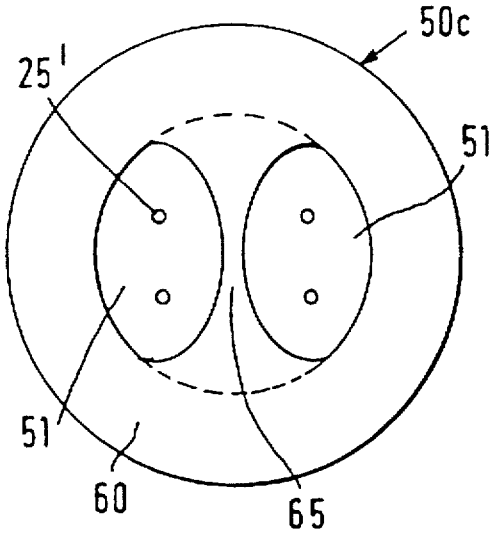
FIG. 6 shows a basic diagrammatic sketch of an atomizing sieve with two symmetrical cambers according to the present invention.

The atomizing sieve 50b represented diagrammatically in FIG. 4 corresponds to that of the second exemplary embodiment shown in FIG. 2. The fuel from all four spray orifices 25 of the perforated spray disc 21 thus enters a single camber 51 of the atomizing sieve 50b, collides with the atomizing sieve 50b, converges partially in the direction of the lowest region 56 and is optimally atomized. In contrast, the atomizing sieve 50d in FIG. 5 possesses four cambers 51, so that the fuel from each spray orifice 25 is aimed into exactly one camber 51 of the atomizing sieve 50d. It is thus possible to treat the sprayed fuel quantity in a quartered manner. Sieve webs 65, which occur between the cambers 51 and which separate the cambers 51 spatially from one another, extend, for example, axially in the region of the circumferential region 60 of the atomizing sieve 50d. FIG. 3 has already illustrated and described in the associated text an exemplary embodiment having the atomizing sieve 50c, on which two cambers 51 are provided into each of which one jet half is aimed. FIG. 6 once again illustrates the situation diagrammatically.

Figure 7:
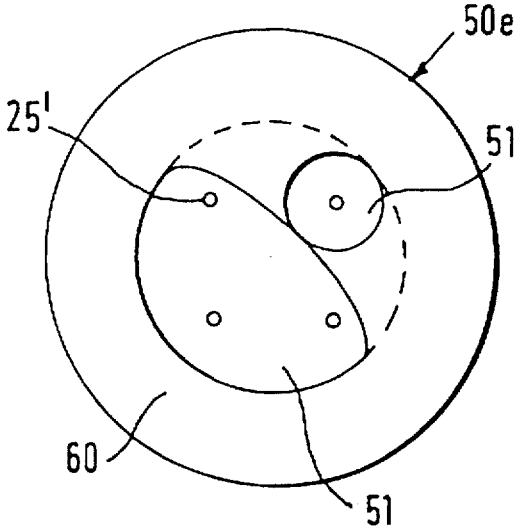
FIG. 7 shows a basic diagrammatic sketch of an atomizing sieve with two asymmetric cambers according to the present invention.

Arrangements, in which, for special purposes, an asymmetric division of the cambers 51 of the atomizing sieve 50e according to FIG. 7 takes place, are also conceivable. The deep-drawing dies must be selected according to a desired asymmetric jet distribution, in order to form the atomizing sieve 50e exactly. Cambers 51 of differing size are also achieved by the use of dies of different size during the deep-drawing. Thus, for example, it is possible, as can be seen in FIG. 7, to provide two cambers 51 different from one another, the fuel which emerges from three spray orifices 25 entering one camber 51, while only a fuel jet from one spray orifice 25 is directed into the second camber 51. The deep-drawing dies can be used in such a way that a) a sieve web 65 remains between the two cambers 51 and thus separates these spatially, that b) the two cambers 51 touch one another and therefore merge into one another if they are located at the same axial depth, that c) the two cambers 51 touch one another at one point, but do not have the same extension in the axial direction, or that d) the two cambers 51 partially overlap.

Figure 8:
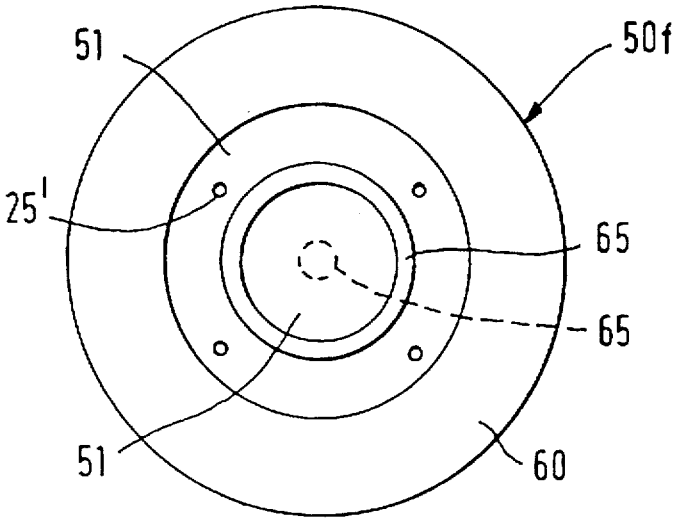
FIG. 8 shows a basic diagrammatic sketch of an atomizing sieve with two annular cambers according to the present invention.

FIG. 8 shows diagrammatically the atomizing sieve 50f which is distinguished by a circular and an annular camber 51. As seen radially from outside, the atomizing sieve 50f is likewise limited at the circumferential region 60 which is finally cast in the protective cap 40. The circumferential region 60 is followed inwards by the continuous annular camber 51 which can be produced easily by means of appropriate annular deep-drawing dies. Towards the middle region of the atomizing sieve 50f, the annular camber 51 is followed by the likewise annular sieve web 65 which thus also limits the inner circular camber 51 relative to the outside. The circular camber 51 and the annular camber 51 can have different widths in the radial direction. As seen in the axial direction of the installed atomizing sieve 50f, the two cambers 51 have their lowest region 56, for example, at the same height, while the sieve web 65 extends, for example, exactly as far as the height of the circumferential region 60. Different jet patterns can be controlled deliberately by means of this arrangement. One version of this design is such that the sieve web 65, as represented by broken lines in FIG. 8, is formed at the center of the atomizing sieve 50f and is surrounded by only one annular camber 51, thus resulting in a cross section of the atomizing sieve 50f which corresponds to the atomizing sieve 50e illustrated in FIG. 3. A particularly favorable equipartition of the fuel quantity is thereby obtained.

Figure 9:
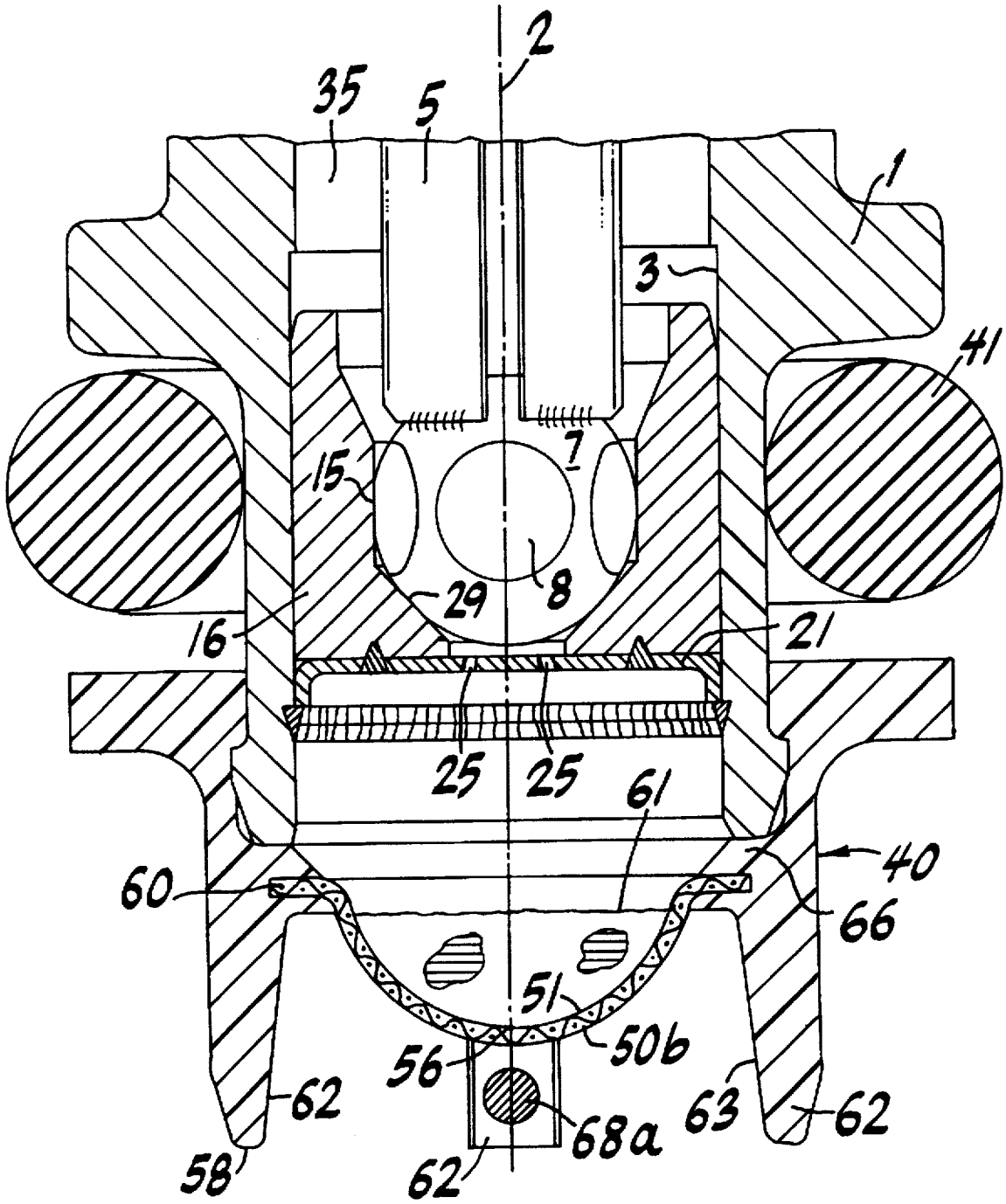
FIG. 9 shows a fourth exemplary embodiment of a fuel injection valve with an atomizing sieve and with a jet divider according to the present invention.

A further exemplary embodiment of the use of the atomizing sieve 50 according to the present invention is illustrated in FIG. 9. The atomizing sieve 50 is designed in the form of the atomizing sieve 50b, that is to say with a single camber 51 formed concavely in the direction of flow. The outer circumferential region 60 of the atomizing sieve 50b is once again cast in the protective cap 40, specifically in an inward-projecting cap region 66 which bears on the valve seat carrier 1 directly downstream of the latter. Directly adjoining the continuous inner cap region 66, for example, four protective prongs 62 of the protective cap 40 designed as a protective crown extend in the axial direction downstream. The four protective prongs 62 are arranged, for example, on the circumference of the protective cap 40 in such a way that they are always at the same distance from one another, that is to say, in each case, are at a distance of 90° from one another. This affords the possibility of mounting a so-called jet divider in the form of a separating web 68a which, for example, has a circular cross section. The separating web 68a is mounted in such a way that it extends downstream of the lowest region 56 of the atomizing sieve 50b transversely through the valve longitudinal axis 2 from one protective prong 62 to the exactly opposite protective prong 62 located at a distance of 180°, and symmetrically divides the spray space enclosed by the protective prongs 62. The at least two spray orifices 25 are also arranged symmetrically to the separating web 68a, so that at least one fuel jet is directed to the right of and at least one fuel jet to the left of the separating web 68a. The mounting of the separating web 68a on the protective prongs 62 takes place very simply, for example by pressing-in, casting-in or the like. The function of the separating web 68a is to produce, maintain or reinforce a desired two-jet feature of the injection valve.

Figure 10:
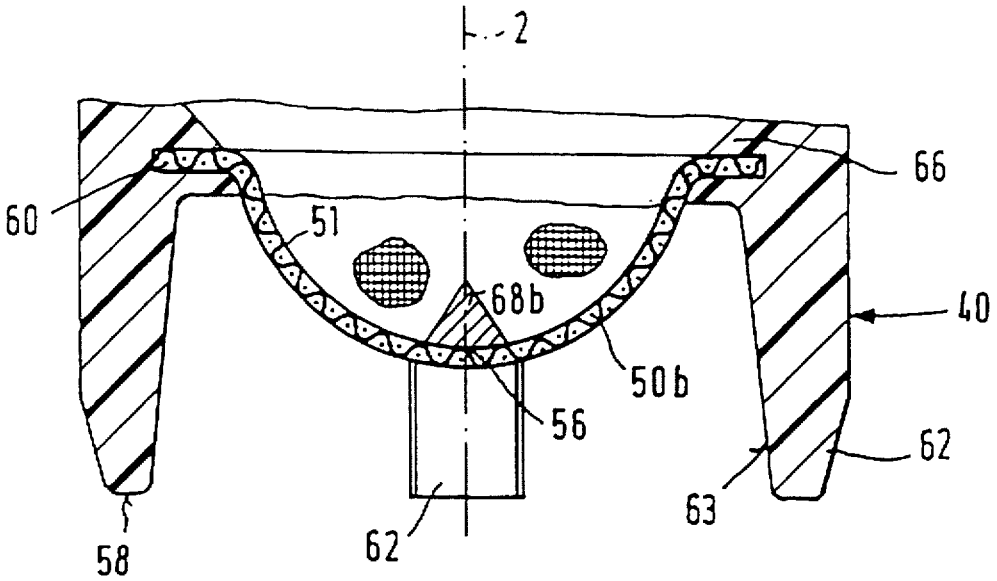
FIG. 10 shows an atomizing sieve and with an integrated jet divider according to the present invention.

FIG. 10 shows a cutout in the region of the atomizing sieve 50b of FIG. 9, the jet divider differing in form and arrangement from the exemplary embodiment illustrated in FIG. 9. Indeed, the jet divider is designed, upstream of the atomizing sieve 50b, in the form of a separating cone 68b. The separating cone 68b is arranged in the lowest region 56 of the atomizing sieve 50b, the cone apex extending towards the perforated spray disc 21. It is possible both to attach the jet divider, for example the separating cone 68b, at a later stage to the already produced atomizing sieve 50b cast in the protective cap 40 and to shape it directly also in the same process of casting in the atomizing sieve 50b. In addition to the conical jet divider 68b, jet dividers having completely different cross-sectional forms, for example as tetrahedra, can also be employed upstream and/or downstream on the sieve surface 55. The use of a plurality of cones is also conceivable. It is expedient for modern internal combustion engines, on which requirements for variable and asymmetric jet trends are placed, to provide jet dividers, such as separating webs 68a and separating cone 68b, which extend asymmetrically in the injection valve, that is to say are not symmetrical to the valve longitudinal axis 2, and can even extend axially at an inclination. These arrangements also depend, for example, on a desired skewing of the atomizing sieve 50b in the injection valve with respect to the valve longitudinal axis 2.

Figure 11:
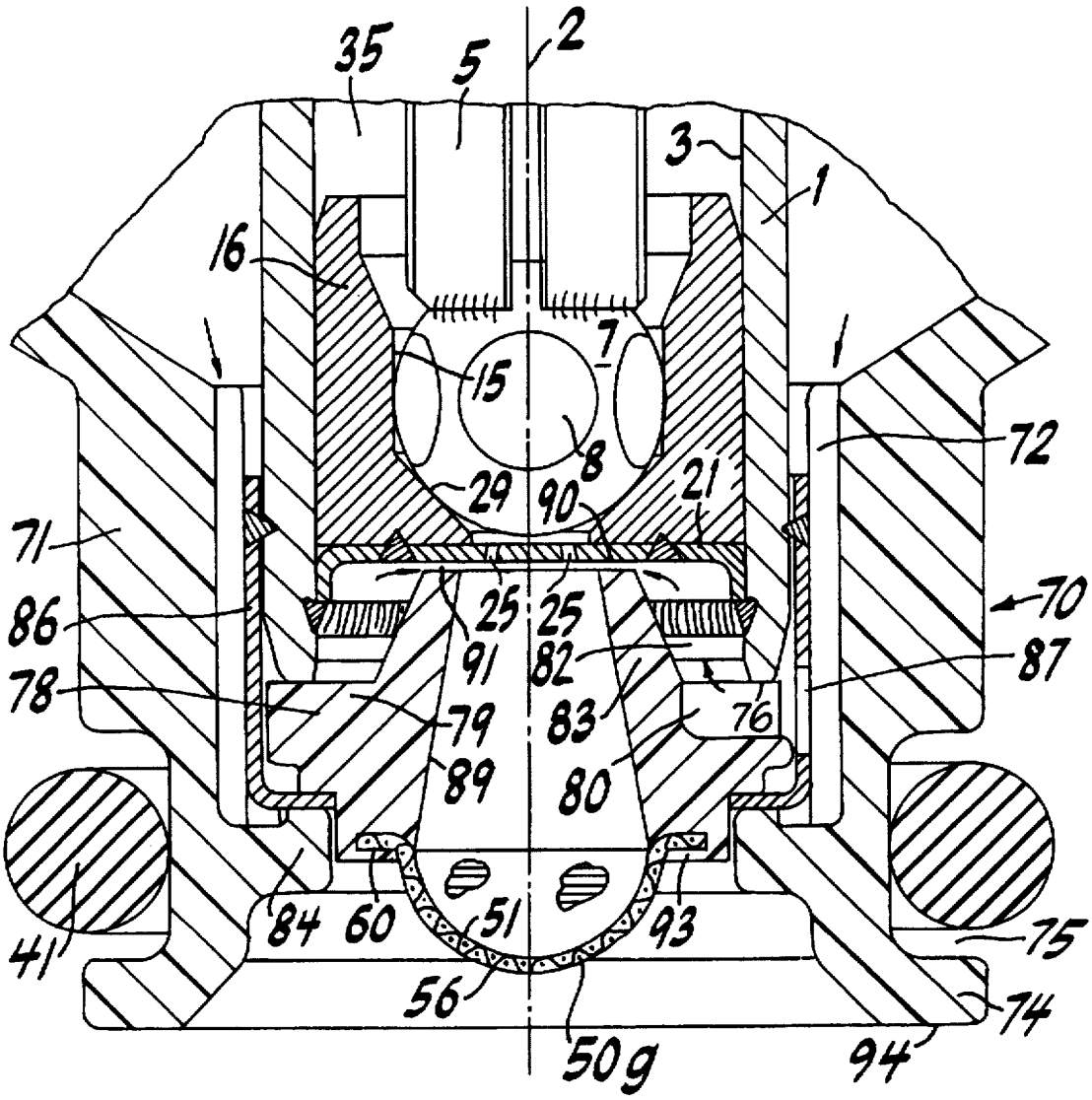
FIG. 11 shows a fifth exemplary embodiment of a fuel injection valve with an atomizing sieve having an upstream gas supply via an annular gap according to the present invention.

FIG. 11 shows an injection valve for the injection of a fuel/gas mixture with an embodiment of the atomizing sieve 50 according to the present invention. At its downstream end, therefore, the valve seat carrier 1 is enclosed at least partially radially and axially by a stepped concentric gas surrounding body 70. The gas surrounding body 70 made of a plastic includes, for example, the actual surrounding by gas at the downstream end of the valve seat carrier 1 and a gas inlet duct, not shown, which serves for supplying the gas into the gas surrounding body 70 and which is made, for example, in one part with the gas surrounding body 70. The design of the gas surrounding body 70 can be varied according to the spatial conditions of a valve receptacle not shown. In the axial region of the extension of the perforated spray disc 21, the gas surrounding body 70 is designed with an axially extending tubular portion 71. The axial portion 71 surrounds the downstream end of the valve seat carrier 1 with a radial clearance for supplying the gas to the fuel emerging from the spray orifices 25 of the perforated spray disc 21. The result of the radial clearance of the gas surrounding body 70 in the portion 71 is that an annular gas inlet duct 72 is formed between the valve seat carrier and the gas surrounding body 70.

The axially extending portion 71 has, at its downstream end, a radially outward-pointing peripheral shoulder 74 which is obtained by making the outer circumference of the gas surrounding body 70 partially recessed radially in order to form an annular groove 75. The sealing ring 41 arranged in this annular groove 75 serves for sealing off between the circumference of the injection valve having the gas surrounding body 70 and a valve receptacle, not shown, for example the suction conduit of the internal combustion engine or a so-called fuel and/or gas distributor conduit.

A stepped insert part 78, for example made from plastic, having a radially extending portion 79 bears at a plurality of circumferential points on a downstream end face 76 of the valve seat carrier 1. In order to guarantee an inflow of the gas into a metering cross section, the axially extending gas inlet duct 72 has adjoining it, for example, three to six radially extending flow ducts 80 which are obtained between the radially extending portion 79 of the insert part 78 and the downstream end face 76 of the valve seat carrier 1 after the mounting of the insert part 78 or of the gas surrounding body 70 and through which the gas flows radially. Thereafter, as indicated by the arrows in FIG. 11, the gas flows axially upstream into an annular duct 82 between a concentric portion 83 of the insert part 78, said portion 83 tapering frustoconically upstream, and the wall of the longitudinal orifice 3 in the valve seat carrier 1 as far as the deflection of the flow in the radial direction at the perforated spray disc 21.

The gas surrounding body 70 presses, with an annular portion 84 extending inwards from the annular groove 75 in the direction of the valve longitudinal axis 2, via a concentric bowl-shaped sleeve 86 which is inserted between the insert part 78 and the gas surrounding body 70 and which is firmly connected to the valve seat carrier 1 and therefore ensures that the insert part 78 is fixed by means of its radial portion 79, against the radial portion 79 of the insert part 78. Thus the inflowing gas can enter the flow ducts 80 solely via orifices 87 in the sleeve 86 and a downstream escape between the gas surrounding body 70 and insert part 78 is ruled out. Finally, the metering of the gas takes place by means of the insert part 78 and the sleeve 86 which engages at least partially under the insert part 78, for the purpose of improved treatment of the fuel emerging from the spray orifices 25 of the perforated spray disc 21. A, for example, conical mixture spray orifice 89 widening downstream is made in the insert part 78 so as to extend centrally and concentrically to the valve longitudinal axis 2.

As a result of the exact gripping of the insert part 78, an axial clearance amount is permanently set between the perforated spray disc 21 and an upper end face 90 of the insert part 78, said upper end face 90 facing the perforated spray disc 21, said axial clearance amount corresponding to the axial extension of an annular gas gap 91 formed thereby. The axial amount of the extension of the annular gas gap 91 forms the metering cross section for the gas, for example treatment air, flowing in from the annular duct 82. The annular gas gap 91 serves for supplying the gas to the fuel discharged through the spray orifices 25 of the perforated spray disc 21 and for the metering of the gas. The gas supplied through the gas inlet duct 72, the orifices 87 of the sleeve 86, the flow ducts 80 and the annular duct 82 flows through the narrow annular gas gap 91 to the mixture spray orifice 89 and there strikes the fuel discharged through the, for example, four spray orifices 25. As a result of the small axial extension of the annular gas gap 91, the supplied gas is sharply accelerated and atomizes the fuel particularly finely. The gas used can, for example, be the suction air branched off by means of a bypass upstream of a throttle flap in the suction pipe of the internal combustion engine, air conveyed by an additional blower, but also recycled exhaust gas of the internal combustion engine or a mixture of air and exhaust gas.

The mixture spray orifice 89 in the insert part 78 has such a large diameter that the fuel, which emerges upstream from the spray orifices 25 of the perforated spray disc 21 and which the gas coming from the annular gas gap 91 strikes perpendicularly for better treatment, can emerge unimpeded through the mixture spray orifice 89 of the insert part 78.

The fuel/gas mixture emerging from the mixture spray orifice 89 of the insert part 78 strikes directly downstream against an atomizing sieve **50*g* which, for example, is firmly cast on or cast in with its peripheral circumferential region 60 on a lower side. 93 of the insert part 78. This guarantees that the fuel already treated by the gas strikes the atomizing sieve 50*g* completely and the treatment quality is further increased. The diameter of the mixture spray orifice 89 at the lower end of the insert part 78 is made, for example, exactly as large as the largest diameter of the camber 51 of the atomizing sieve 50*g* which is exactly in the plane of the circumferential region 60. The dish-like atomizing sieve 50*g* is once again made concave in the direction of flow and projects with its lowest region 56 in the axial direction, within the gas surrounding body 70, for example as far as the shoulder 74 of the gas surrounding body 70. However, in this exemplary embodiment too, the shoulder 74 forming the downstream end of the gas surrounding body 70 is located with its shoulder end 94 further downstream than the atomizing sieve 50*g*, in a similar way to the cap end 58** of the preceding exemplary embodiments, so that protection against mechanical effects is guaranteed.

Figure 12:
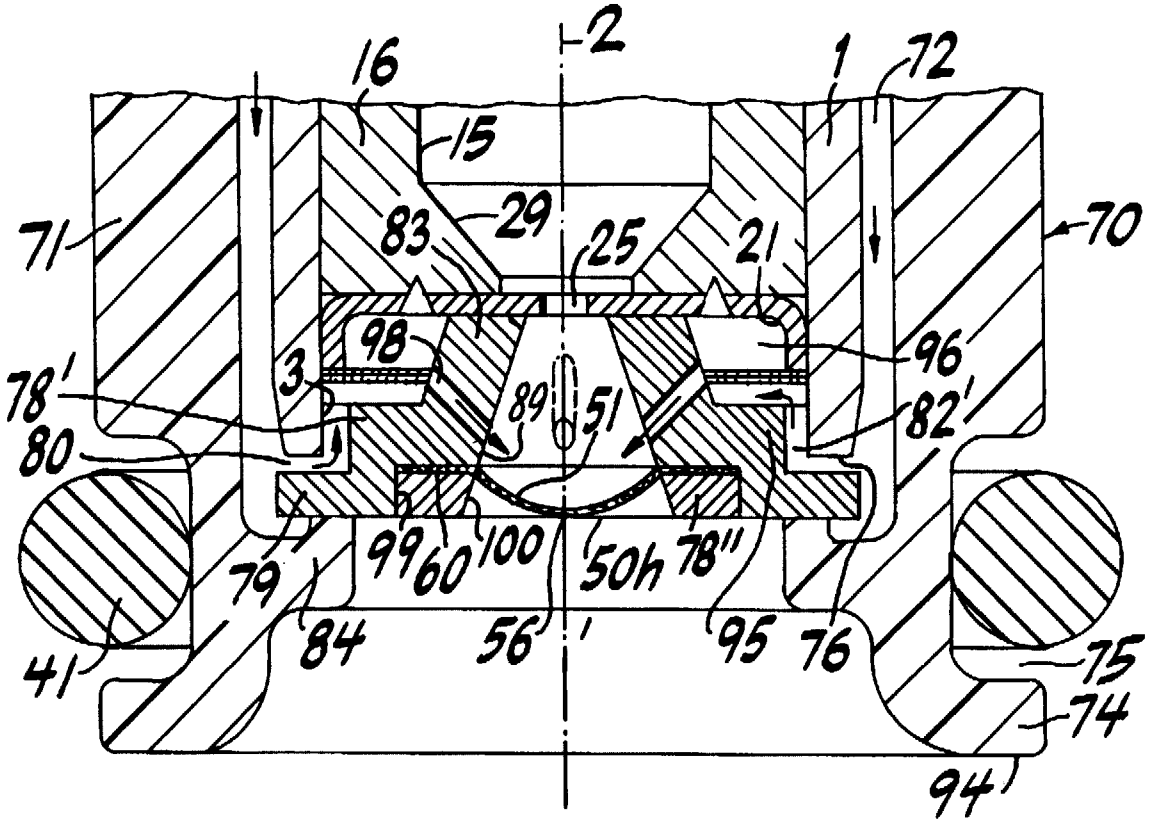
FIG. 12 shows a sixth exemplary embodiment of a fuel injection valve with an atomizing sieve having an upstream gas supply via supply ducts according to the present invention.

The next exemplary embodiment according to the present invention of a surrounding by gas with a downstream atomizing sieve **50*h* is shown in FIG. 12, which is to be understood merely as a basic sketch. As in the preceding exemplary embodiments, the valve seat carrier 1 is enclosed at its downstream end at least partially radially and axially by the stepped concentric gas surrounding body 70. The axial portion 71 of the gas surrounding body 70 surrounds the downstream end of the valve seat carrier 1 with a radial clearance for the supply of the gas, so that the annular gas inlet duct 72 is obtained. Arranged at least partially inside the valve seat carrier 1 downstream of the perforated spray disc 21 is a stepped insert part 78' which, for example, is clamped or welded to the inner wall of the valve seat carrier 1 in the longitudinal orifice 3. In order to guarantee an inflow of the gas to the fuel emerging from the perforated spray disc 21, there adjoins the axially extending gas inlet duct 72 an annular radially extending flow duct 80 which is obtained between the lower radially extending portion 79 of the insert part 78' and the downstream end face 76 of the valve seat carrier 1 after the mounting of the insert part 78' or of the gas surrounding body 70 and through which the gas flows radially. Thereafter, as the arrows in FIG. 12 show, the gas flows axially upstream into, for example, four intermediate ducts 82' between a concentric axial insert portion 95 of the insert part 78' and the wall of the longitudinal orifice 3 in the valve seat carrier 1 as far as an annular space 96 which is formed between the perforated spray disc 21, the portion 83 of the insert part 78', said portion 83 tapering frustoconically upstream, and the axial insert portion 95. Outside the four intermediate ducts 82', the insert part 78' bears with its axial insert portion 95 on the wall of the longitudinal orifice 3**, for example by means of clamping.

The gas surrounding body 70 presses with the annular portion 84 against the insert part 78' which in turn presses with its upper end face, facing the perforated spray disc 21, against the perforated spray disc 21, so that the insert part 78', in addition to being secured in position on the wall of the longitudinal orifice 3, has an additional fixing. This also guarantees that the gas coming from the gas inlet duct 72 enters the space 96 solely via the flow duct 80. In the frustoconically tapering portion 83 of the insert part 78', for example four obliquely radially extending supply ducts 98 for the gas are arranged at an equal distance from one another, that is to say at 90° in each case. These supply ducts 98 make a connection of the annular space 96 to the conically designed mixture spray orifice 89 extending centrally and concentrically to the valve longitudinal axis 2 in the insert part 78' and widening downstream. In the axial extension of the radial portion 79 of the insert part 78', an insert part 78" is introduced with a smaller outside diameter, for example by interlocking or clamping, in a recess 99 provided at the downstream end of the insert part 78'. The atomizing sieve **50*h* can be gripped in the recess 99 between the insert part 78' and insert part 78"**.

The insert part 78" likewise possesses centrally and concentrically to the valve longitudinal axis 2 an orifice 100 which continues the conicity of the mixture spray orifice 89 and in which the atomizing sieve **50*h* is located with its camber 51. Consequently, only the circumferential region 60 of the atomizing sieve 50*h* is gripped between the two insert parts 78' and 78"**.

The supply ducts 98 serve for supplying the gas to the fuel discharged through the at least one, for example, four spray orifices 25 of the perforated spray disc 21 and for the metering of the gas. The supplied gas is accelerated in the supply ducts 98 and strikes the fuel in the mixture spray orifice 89. The supply ducts 98 are oriented exactly in such a way that their imaginary extensions meet in the center of the atomizing sieve **50*h*, that is to say in the lowest region 56. The fuel emerging from the spray orifices 25 thus strikes the fuel collecting in the lowest region 56, and moreover the gas flows exactly into this striking region. The fuel is consequently atomized particularly finely. The fuel jets emerging from the spray orifices 25 can be aimed both directly into the center of the atomizing sieve 50*h* and, as parallel fuel jets, at regions outside the lowest region 56 or, as diverging fuel jets, at edge regions of the camber 51 of the atomizing sieve 50*h*. The supplied gas does not necessarily have to flow towards the center of the atomizing sieve 50*h*, but can also be directed towards other regions of the camber 51, for example to the striking regions of the fuel on the atomizing sieve 50h. The atomizing sieve 50h is shaped, for example, with its camber 51 in such a way that it does not project downstream out of the insert parts 78' and 78". The advantage of the design with two insert parts 78' and 78" is that an exchange of the atomizing sieves 50**, which differ, for example, in the form of the camber or in the mesh width, can be carried out in a very short time.

Figure 13:
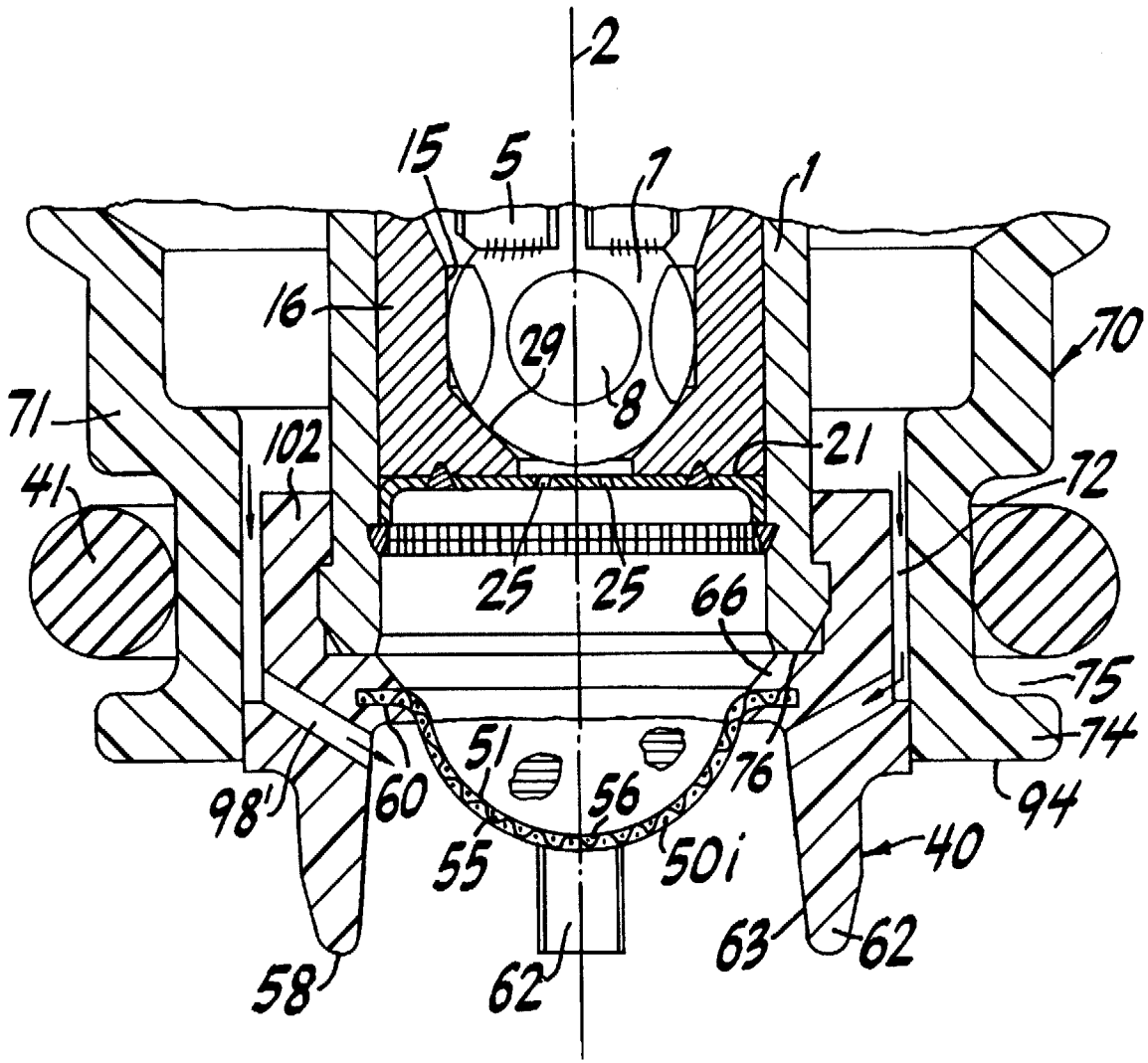
FIG. 13 shows a seventh exemplary embodiment of a fuel injection valve with an atomizing sieve having a downstream gas supply via supply ducts according to the present invention.

A further exemplary embodiment according to the present invention, which is illustrated in FIG. 13, is distinguished by a gas supply located downstream of the atomizing sieve 50i. In a similar way to the exemplary embodiment illustrated in FIG. 2, here too the protective cap 40 forming the downstream end of the injection valve is provided. The fastening of the protective cap 40 likewise takes place, for example, via a snap connection on the valve seat carrier 1, said snap connection taking effect when the protective cap 40 bears with its continuous inner cap region 66, in which the atomizing sieve 50i is also cast with its circumferential region 60, on the downstream end face 76 of the valve seat carrier 1. The atomizing sieve 50i cast in the protective cap 40 is likewise cambered in a dish-like manner concavely in the direction of flow and is produced, for example, from a rust-proof metal.

The atomizing sieve 50i is embedded into the protective cap 40 by means of an amount of setback, that is to say the cap end 58 of the protective cap 40 limits the injection valve downstream, while the lowest region 56 of the atomizing sieve 50i is located further upstream. The protective cap 40 is likewise designed in the form of a protective crown which has, for example, four axially extending protective prongs 62. In a symmetrical arrangement of the protective prongs 62, these are in each case at a distance of 90° from one another. The protective crown once again affords the advantage of an improved dripping behavior of the injection valve.

The protective cap 40 in the exemplary embodiment of the present invention illustrated in FIG. 13 no longer forms a radial wall of the annular groove 75 receiving the sealing ring 41, but partially limits the annular gas inlet duct 72 for the supply of the gas. Indeed, at its downstream end, the valve seat carrier 1 and the protective cap 40 are enclosed at least partially radially and axially by the stepped concentric gas surrounding body 70. In the axial region of the extension of the perforated spray disc 217 the gas surrounding body 70 is designed with the axially extending tubular portion 71. The axial portion 71 surrounds an annular cap end part 102, by means of which the snapping on the valve seat carrier 1 takes place and which is located exactly opposite the protective prongs 62 in the axial direction, with a radial clearance for the supply of the gas to the fuel atomized at the atomizing sieve 50i. The result of the radial clearance of the gas surrounding body 70 in the portion 71 relative to the protective cap 40 is that the annular gas inlet duct 72 is formed.

The axially extending portion 71 has, at its downstream end, the radially outward-pointing shoulder 74 which is obtained by making the outer circumference of the gas surrounding body 70 recessed partially radially in order to form the annular groove 75 for the sealing ring 41, specifically in the axial extension, exactly where the gas inlet duct 72 extends within the gas surrounding body 70. The gas surrounding body 70 and the protective cap 40 are fixedly and sealingly connected to one another in the region of the shoulder 74, for example by means of welding or adhesive bonding. This guarantees that no gas emerges in the direction of the suction conduit of the internal combustion engine between the gas surrounding body 70 and the protective cap 40.

Provided between the cap end part 102 or the cap region 66 having the cast-in circumferential region 60 of the atomizing sieve 50i and the protective prongs 62 of the protective cap 40 are, for example, four obliquely radially extending supply ducts 98' for the gas which start at the downstream end of the gas inlet duct 72, are directed towards the atomizing sieve 50i and end at the inner wall 63 of the protective cap on the side of the atomizing sieve 50i facing away from the perforated spray disc 21. The supply ducts 98', for example formed at a distance of 90° from one another, are oriented in such a way that their imaginary extensions, preferably those of the center lines of the supply ducts 98', meet approximately in the center of the atomizing sieve 50i, that is to say in the lowest region 56 of the atomizing sieve 50i. Another possibility for the orientation of the supply ducts 98' is that the imaginary extensions meet the atomizing sieve 50i exactly at the points at which the individual fuel jets coming from the spray orifices 25 of the perforated spray disc 21 strike the inner sieve surface 55 of the camber 51 of the atomizing sieve 50i, this being equivalent, for example, to a tangential contact. The gas flowing through the gas inlet duct 72 is accelerated in the supply ducts 98' and then at least partially strikes the outer sieve surface of the cambered atomizing sieve 50i. The gas is swirled when it strikes the atomizing sieve 50i, on the one hand passes through partially to the inner sieve surface 55 and on the other hand flows outside the atomizing sieve 50i in the direction of the lowest region 56 of the atomizing sieve 50i. The supply ducts 98' can also be oriented in such a way that the gas strikes the fuel mist, emerging from the atomizing sieve 50i, only downstream of the atomizing sieve 50i.

A further improvement in the fuel atomization is achieved by means of this gas supply located downstream of the atomizing sieve 50i. Moreover, this version is particularly cost-effective, since the supply ducts 98' can be made in the protective cap 40 in a very simple way and an annular gas gap is dispensed with completely. Despite the surrounding by gas, desired fuel jet angles are largely maintained, since the fuel is not surrounded completely over its circumference by the gas emerging from the supply ducts 98'.

Figure 14:
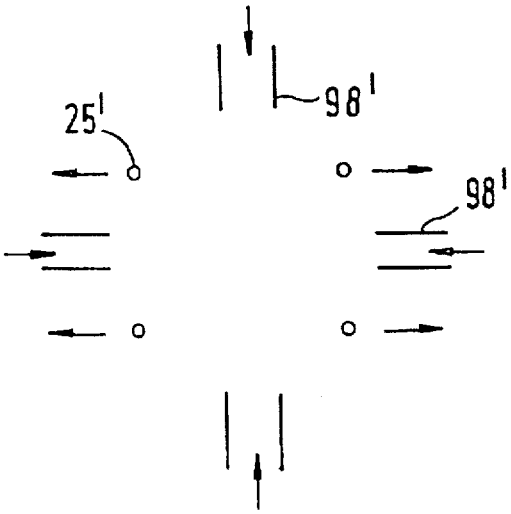
FIG. 14 shows a first basic diagrammatic sketch of the supply ducts according to the present invention.
Figure 15:
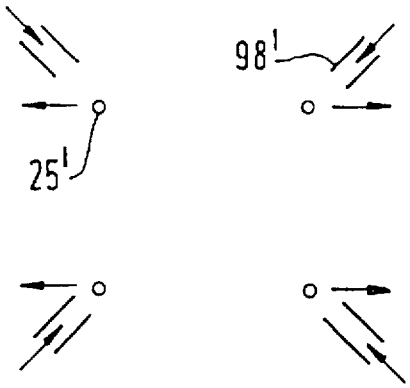
FIG. 15 shows a second basic diagrammatic sketch of the supply ducts according to the present invention.
Figure 16:
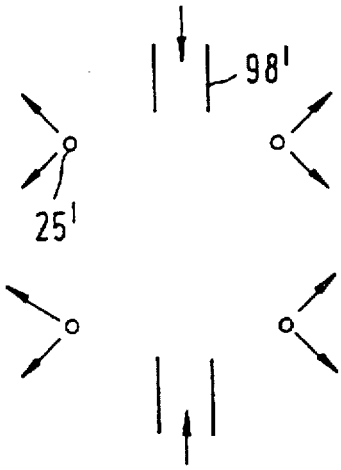
FIG. 16 shows a third basic diagrammatic sketch of the supply ducts according to the present invention.

FIGS. 14, 15 and 16 are merely basic diagrammatic sketches which show possible versions of the trend of the supply ducts 98', shown in FIG. 13, for the gas in relation to the projected spray orifices 25' of the perforated spray disc 21. In the exemplary embodiment illustrated in FIG. 14, the supply ducts 98' are designed as two pairs of ducts which differ in their cross-sectional size, thereby achieving a gas supply of differing intensity which in turn allows a deliberate control of the jet pattern of the fuel. Each pair of ducts is formed by two supply ducts 98' located exactly at 180° opposite one another, all the supply ducts 98' extending in each case between two projected spray orifices 25'. The pairs of ducts may differ from one another not only in their cross-sectional size, but also in their cross-sectional forms which, for example, can be circular, quadrangular or oval. The arrows indicate the directions of flow of the gas and of the fuel. In two-jet valves, the two-jet feature can be produced, maintained or reinforced very effectively by means of the asymmetric gas-quantity distribution. The two pairs of ducts can also be replaced perfectly well by supply ducts 98' which are made asymmetrically in the circumferential direction in the protective cap 40 and which can also be made variably in their inclination relative to the valve longitudinal axis 2. FIG. 15 shows a further exemplary embodiment according to the present invention, in which the supply ducts 98' are oriented in such a way that their imaginary extensions meet the projected spray orifices 25' or the collision points of the fuel on the atomizing sieve **50*i***.

A conical fuel jet obtained, for example, as a result of the inclination of the spray orifices 25 of the perforated spray disc 21 can be broken up into two fuel jets by the supply ducts 98' for the gas, so that the individual fuel jet existing directly at the atomizing sieve 50 is divided in an advantageous way into two fuel jets, for example each fuel jet constituting half the fuel quantity of the originally individual fuel jet The arrows at the projected spray orifices 25' illustrate that the fuel is divided away from the supply ducts 98'.

Figure 17:
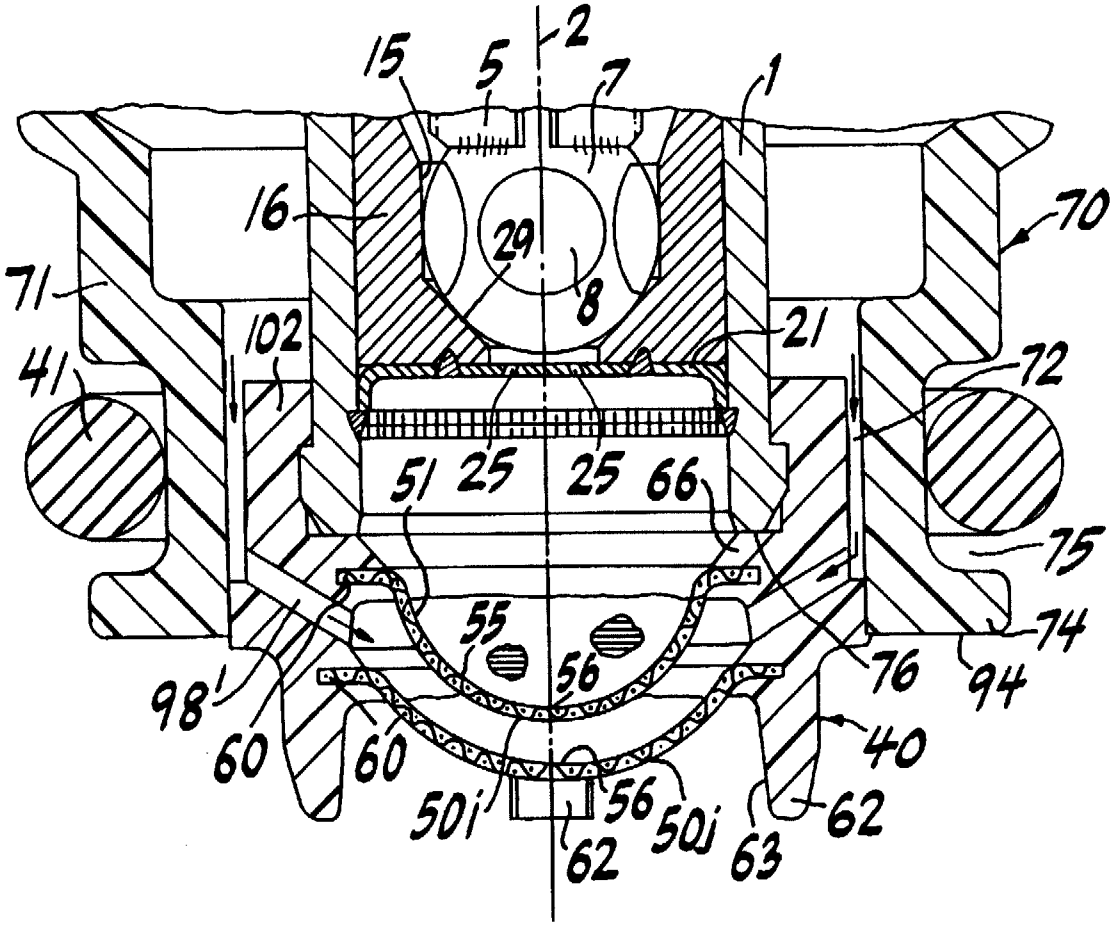
FIG. 17 shows an eighth exemplary embodiment of a fuel injection valve with two atomizing sieves and an interposed gas supply according to the present invention.

A further exemplary embodiment of a fuel injection valve having an atomizing-sieve arrangement according to the present invention is illustrated in FIG. 17. Indeed, for a further improvement in the atomizing quality or for an optimum jet-pattern control, a plurality of atomizing sieves, here the atomizing sieves **50*i* and 50*j*, are connected in series. The atomizing sieves 50*i* and 50*j* can, for example, be designed at a constant distance from one another, that is to say essentially parallel. The casting of the circumferential regions 60 in the protective cap 40 takes place, for example, in one process step. Instead of casting in the circumferential regions 60 of the individual atomizing sieves 50*i*, 50*j*, the atomizing sieves 50*i*, 50*j* can be provided individually with clamping rings 52, as shown, for example, in FIG. 1, and be stacked one above the other or inserted one behind the other in the protective cap 40 by means of insert parts 78 similar to the insert parts 78" shown in FIG. 12. For this purpose, the protective cap 40 can expediently be made multi-part. In all the exemplary embodiments according to the present invention, the atomizing sieve 50 together with the protective cap 40** can be used as an exchangeable treatment attachment which can be attached to the most diverse types of injection valves.

At the same time, the circumferential region 60 of the atomizing sieve **50*i* can be provided upstream and the circumferential region 60 of the atomizing sieve 50*j* downstream of the supply ducts 98', so that the gas supply takes place exactly between the two atomizing sieves 50*i* and 50*j*. Further exemplary embodiments according to the present invention not shown are obtained by varying the fabric widths, the number of atomizing sieves 50 and the arrangement of the supply ducts 98' in relation to the atomizing sieves 50. The supply ducts 98' can perfectly well be designed in such a way that the gas flows in downstream of the last atomizing sieve 50 and/or upstream of the first atomizing sieve 50** and/or between the two.

Figure 18:
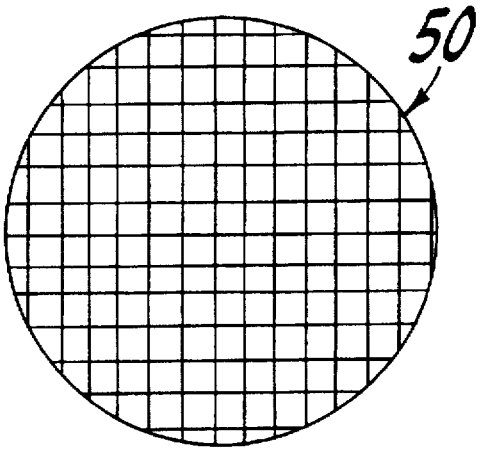
FIG. 18 shows an atomizing sieve with square meshes according to the present invention.
Figure 19:
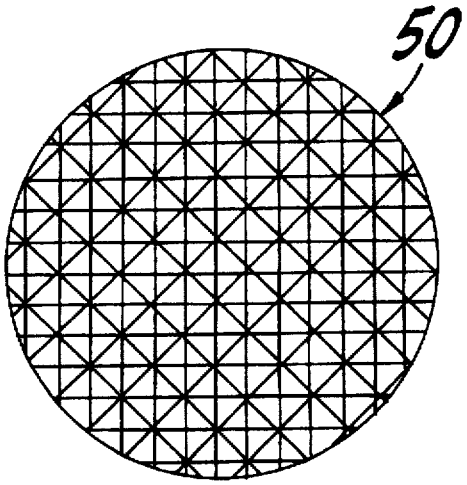
FIG. 19 shows an atomizing sieve with a multi-layer fabric pattern according to the present invention.
Figure 20:
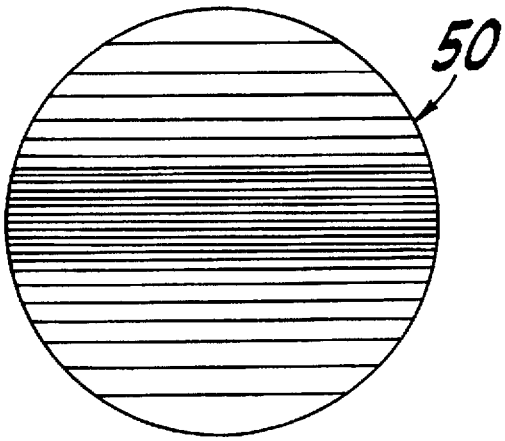
FIG. 20 shows an atomizing sieve with a fabric compacted towards the middle of the sieve according to the present invention.
Figure 21:
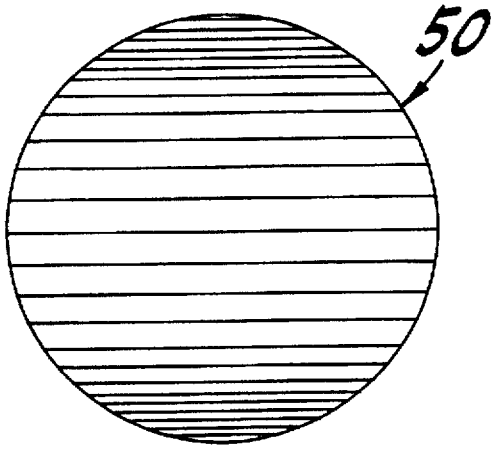
FIG. 21 shows an atomizing sieve with a fabric compacted towards the outer zone of the sieve according to the present invention.

FIGS. 18 and 19 illustrate byway of example possible types of interlacing of the atomizing sieves 50. Thus, the atomizing sieve 50 shown diagrammatically in FIG. 18 possesses square meshes, while, in the atomizing sieve 50 in FIG. 19, two-layer or multi-layer fabric patterns offset relative to one another are provided. It becomes clear from FIGS. 20 and 21 that the mesh width can be made variable. Thus, to adapt the atomizing quality over the area, the fabric of the sieve leaf of the atomizing sieve 50 in FIG. 20 is compacted towards the middle, whereas, in FIG. 21, the fabric of the atomizing sieve 50 becomes denser towards the outer zone of the sieve. However, it is necessary to ensure that the mesh width does not fall short of 0.1 mm, since, otherwise, too much fuel collects in the at least one camber 51 of the atomizing sieve 50, thereby in turn entailing an impairment of the atomizing quality. The best atomization results are achieved with a mesh width of $\geqq 0.2$ mm.

Figure 22:
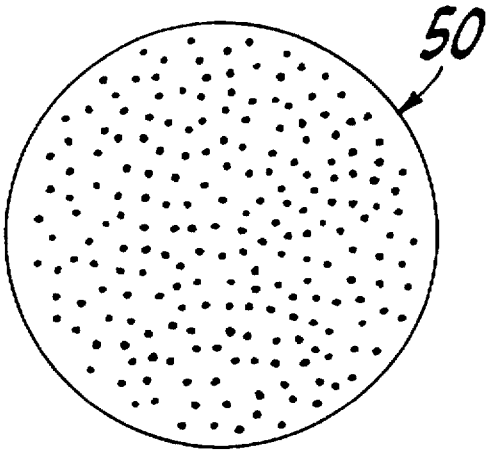
FIG. 22 shows an atomizing sieve in the form of a perforated body according to the present invention.

FIG. 22 shows an atomizing sieve 50 according to the present invention in the form of a perforated body which possesses over the entire area small holes or orifices having equal or unequal cross-sectional sizes. The atomizing sieve 50 illustrated in FIG. 23 possesses only longitudinal meshes which are limited at their edges solely by the circumference of the atomizing sieve 50. This form of design is to be achieved by means of very closely stretched wires made, for example, from rust-proof metal. The advantages of these special forms of sieve are, in addition to very good atomization, the generation of completely new jet patterns. The atomizing sieves 50 can also be produced from a semiconductor material, for example as silicon wafers, into which meshes or holes are etched according to FIGS. 18 to 23.

In addition to variations in the types of interlacing and mesh widths, there are further possibilities for the design of the sieve fabrics or sieve leaves which cannot be seen from the figures. Thus, for example, fabric material can be used with a circular, oval or quadrangular cross section, depending on the requirements. Particularly suitable as fabric material are rust-proof metal or also TEFLON® which is hydrophobic and which therefore prevents icing-up at temperatures down to −40° C., or PTC materials, that is to say materials with positive resistance/temperature coefficients, the resistance of which increases under heating. Bimetallic sieves have the advantage that the geometry of the atomizing sieve, for example the shape of the camber, can be varied in a desired way at different operating temperatures for the purpose of a jet-angle variation dependent on the operating point.

The figures do not show atomizing sieves which are not installed at right angles to the valve longitudinal axis 2 in the injection valve, that is to say have a skew position in order to be capable of generating asymmetric jet patterns or of injecting optimally into bent suction pipes of internal combustion engines. In order to achieve an optimum atomizing quality of the fuel, the atomizing sieves 50 have at least one concave camber 51, as seen in the direction of flow of the fuel. Yet precisely with a view to the prevention of icing-up, of so-called plugging and of settlements of lead sulfate on the perforated spray disc 21 and on other components inside the injection valve, it may be expedient to use atomizing sieves which are largely plane, pyramidal or cambered convexly, as seen in the direction of flow.

Figure 24:
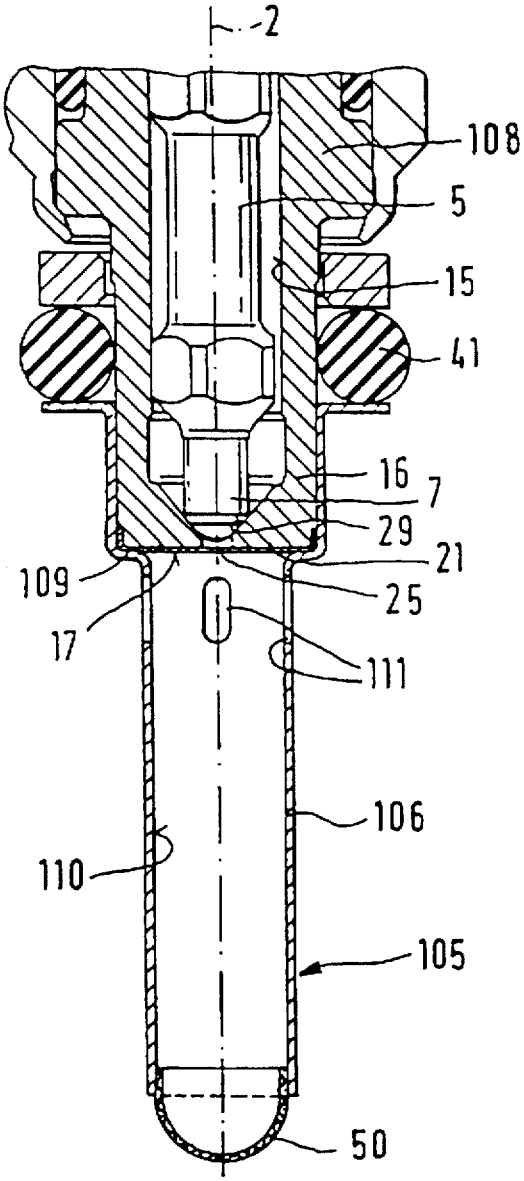
FIG. 24 shows a first example of a spacer body attached to a fuel injection valve having an atomizing sieve according to the present invention.

FIG. 24 and the subsequent figures illustrate at least partially, as further exemplary embodiments, valves in the form of injection valves for fuel injection systems of mixture-compressing spark-ignition internal combustion engines having atomizing sieves 50 according to the present invention which, although differing in the form of design, particularly in the regions of the valve needle 5, the valve closing body 7 and the valve seat body 16, from the previously explained injection valves shown particularly in FIGS. 1 to 17, nevertheless in no way suggest an exclusive use of the various atomizing sieves 50 according to the present invention in the particular valve types shown. Thus, all the abovementioned and illustrated designs of the atomizing sieves 50 can be used or fitted on the most diverse injection valves. The injection valve partially shown in FIG. 24 is already known per se and therefore will not be explained in more detail.

Figure 23:
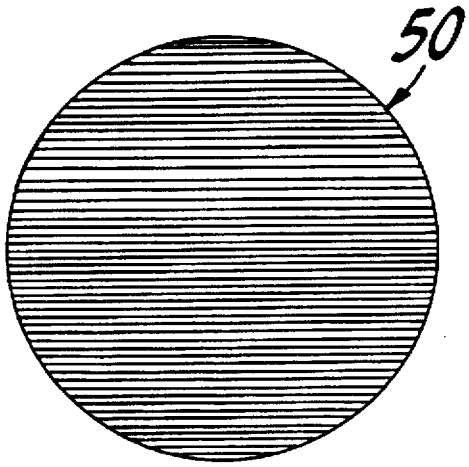
FIG. 23 shows an atomizing sieve with closely stretched wires in one direction according to the present invention.

All the exemplary embodiments illustrated subsequent to FIG. 23 are distinguished particularly in that there is provided a clear spatial separation of the metering and treatment of the fuel which is achieved in constructive terms by means of an extension element designated as an atomizer attachment 105. The atomizer attachment 105 includes a sleeve-shaped elongate spacer body 106 and the atomizing sieve 50 cambered, for example, concavely, as seen in the direction of flow, at its downstream end facing away from the perforated spray disc 21 having the at least one spray orifice 25. The aim is, by means of the atomizer attachment 105, with the injection valve being in a fixed installation position, to place the point of fuel atomization into the ideal position in the airflow of the suction pipe of the internal combustion engine and thereby to reduce or prevent a wall-film formation of the fuel in the suction pipe or manifold, with the result that a clear reduction in the exhaust-gas emission, especially of the fraction of HC, is achieved as a consequence.

The injection valve has, as part of a valve housing, a nozzle body 108 extending at the downstream end, the downstream end of the nozzle body 108 constituting the valve seat body 16. Formed in the nozzle body 108 is the stepped guide orifice 15 which extends concentrically to the valve longitudinal axis 2 and in which the valve needle 5 together with the valve closing body 7 is arranged. The guide orifice 15 of the nozzle body 108 possesses, at its end facing the atomizer attachment 105, the fixed valve seat face 29 which tapers frustoconically in the direction of the fuel flow and which, together with the valve closing body 7 likewise tapering frustoconically, forms a seat valve. The perforated spray disc 21 bears on the lower end face 17 of the nozzle body 108, said lower end face 17 facing the atomizer attachment 105, and is firmly connected to the nozzle body 108, for example by a weld seam made by means of laser welding. The perforated spray disc 21 has, for example, a spray orifice 25, through which the fuel flowing past the valve seat face 29 when the valve closing body 7 is lifted off is sprayed into the atomizer attachment 105.

The sleeve-shaped spacer body 106 is, for example, of stepped design, so that it partially surrounds directly in the axial direction the end of the nozzle body 108, said end being designated as a valve seat body 16, and, for example, also bears to a slight degree on the perforated spray disc 21 by means of a radially extending shoulder 109. The shoulder 109 reducing the cross section of the spacer body 106 results in a diameter of the spacer body 106 downstream of the perforated spray disc 21 which is smaller than the outside diameter of the valve seat body 16. Starting from the shoulder 109, the spacer body 106 extends into the suction pipe, not shown, that is to say in the downstream direction, for example with a constant diameter. At the end of the spacer body 106 facing away from the atomizing sieve 50, said spacer body 106 is shaped in such a way that it extends radially and thereby jointly forms an annular groove, in which the sealing ring 41 serving for sealing off relative to the suction pipe is received. As possibilities for the suitable fastening of the spacer body 106 to the nozzle body 108, for example, releasable interlock, snap or clip connections, for which grooves or elevations are provided correspondingly on the nozzle body 108, are appropriate.

In order to prevent a disturbing wetting of the inner wall 110 of the spacer body 106, the injection valve must inject a radially narrow fuel jet with as small an opening angle as possible, that is to say a so-called pencil-shaped jet. Such pencil-shaped jets can be generated, for example, by means of a perforated spray disc 21 having a central spray orifice 25 and by means of the valve type shown in FIG. 24. Provided downstream of the perforated spray disc 21, but in the upper part of the spacer body 106 facing it, are orifices 111 which are arranged, for example, symmetrically on the circumference of the spacer body 106. The air jets entering through the orifices 111 are directed in such a way that they are not aimed at the atomizing sieve 50. In particular, the orifices 111 are located nearer to the spray orifice 25 than to the atomizing sieve 50. The, for example, two to eight orifices 111 in the spacer body 106, which are designed as long holes, slits or circular bores, subsequently allow an airflow parallel to the fuel jet inside the spacer body 106. Indeed, as a result of the fuel jet emerging from the spray orifice 25, suction-pipe air is sucked into the orifices 111 on the principle of the water-jet pump. The negative pressure otherwise occurring downstream of the perforated spray disc 21 in the spacer body 106 and therefore also the air backflow within the spacer body 106 from the atomizing sieve 50 to the injection valve or the swirling of the fuel jet, are thereby avoided. An air backflow in the spacer body 106 would lead to a highly disadvantageous wetting of the inner wall 110 with fuel. The afterdripping of fuel when the injection valve is switched off can now be largely prevented by this measure. The exemplary embodiment illustrated in FIG. 24 is particularly advantageous, since the atomizer attachment 105 having the spacer body 106 can, as a result of its simple design, be cost-effectively produced and mounted on the injection valve and nevertheless performs all the desired functions.

Figure 25:
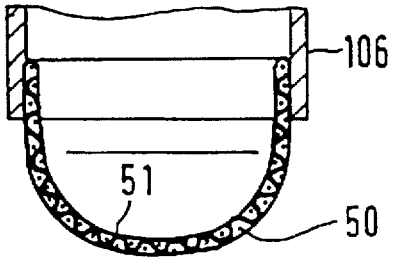
FIG. 25 shows an enlarged view of the atomizing sieve shown in FIG. 24.
Figure 26:
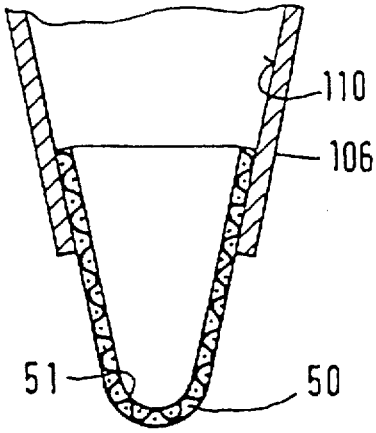
FIG. 26 shows a positively conical atomizing sieve according to the present invention.
Figure 27:
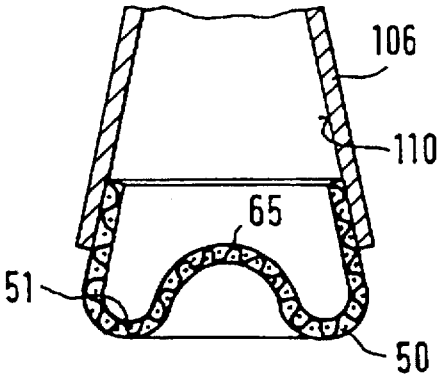
FIG. 27 shows a negatively conical atomizing sieve according to the present invention.

FIGS. 25, 26 and 27 show various exemplary embodiments according to the present invention of atomizing sieves 50 fastened to spacer bodies 106, FIG. 25 representing only an enlargement of the region of the atomizing sieve from FIG. 24. Expediently, in the case of spacer bodies 106 made of plastic, the atomizing sieve 50 is jointly injected directly in the process for producing the spacer body 106 by injection molding. According to the materials used (for example also metal) for the spacer body 106 and the atomizing sieve 50, other assembly methods, such as welding, soldering or adhesive bonding, can also be employed. As shown in FIGS. 25 to 27, there is, for example, a slight axial overlap of the spacer body 106 and atomizing sieve 50, the spacer body 106 partially surrounding the atomizing sieve 50.

FIGS. 26 and 27 illustrate exemplary embodiments according to the present invention, in which the spacer body 106 does not have a constant diameter, but respectively extends positively and negatively conically, that is to say has respectively a widening and a tapering towards the atomizing sieve 50. These cross-sectional variations over the axial length of the spacer body 106 are possible whenever the fuel is prevented from striking the inner wall 110. The atomizing sieve 50 can be used for shaping the fuel spray to be injected so that it has different geometrical designs with differently shaped cambers 51, three of which are shown by way of example in FIGS. 25 to 27. According to the geometry of the spacer body 106, the atomizing sieve 50 possesses, for example, a somewhat acutely tapering camber 51 (FIG. 26) or two cambers 51 which are separated from one another by a central inner sieve web 65 (FIG. 27). The last-mentioned version is appropriate particularly for injection to two inlet valves of the internal combustion engine. Moreover, according to the exemplary embodiment illustrated in FIG. 27, the camber 51 can be made annular and completely surrounds the inner sieve web 65.

The spatial separation of the metering and treatment is thus essential to these exemplary embodiments. The metering takes place by means of the perforated spray disc 21 and the treatment by means of the atomizing sieve 50. The fuel leaves the metering perforated spray disc 21 at a high velocity as a pencil-shaped jet and, with typical distances of 5–50 mm from the atomizing sieve 50, is not appreciably braked or deflected, so that the already described good treatment of the fuel by the atomizing sieve 50 is preserved. With the same types of injection valve, the ideal treatment position can be found for each internal combustion engine and each suction pipe by means of the spacer-body lengths adaptable within wide limits. While the driving quality remains the same, the consumption-increasing and emission-increasing cold-starting and acceleration enrichment with fuel can be cut back sharply, since the wall-film formation in the suction pipe is greatly reduced or even prevented as a result of the atomizer attachment 105.

Figure 28:
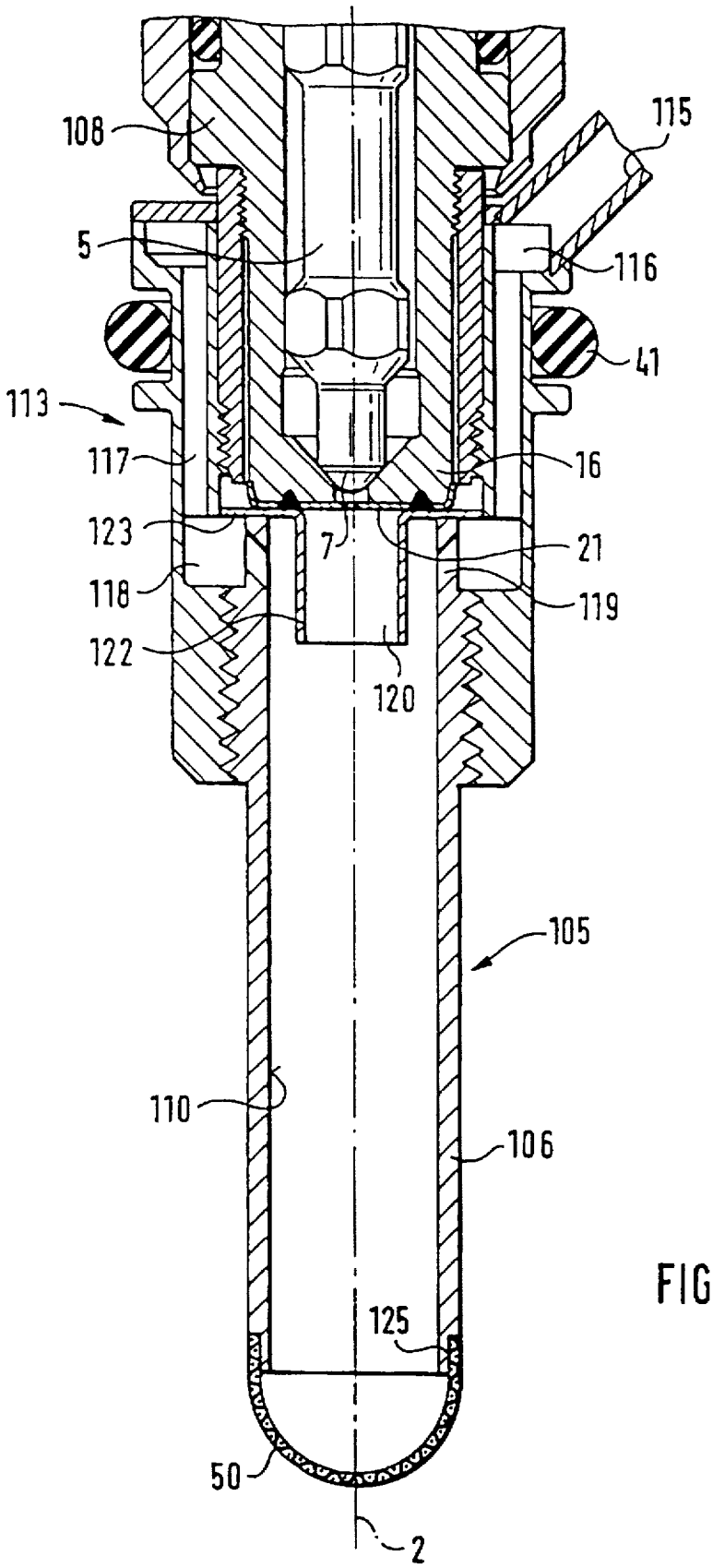
FIG. 28 shows a second example of a spacer body attached to a fuel injection valve having an atomizing sieve according to the present invention.

FIG. 28 shows a further exemplary embodiment of an injection valve according to the present invention which corresponds in terms of design and technical principle to the injection valve illustrated in FIG. 24 and which likewise has an atomizer attachment 105, by means of which, as a result of the spacer body 106, the atomizing sieve 50 according to the present invention is formed at a clear spatial distance from the metering point. The exemplary embodiment shown represents in simplified form a test setup which is mainly intended to explain the technical principle and which can perfectly well also be made distinctly different from this arrangement in terms of construction.

In this exemplary embodiment according to the present invention, the atomizer attachment 105 is not only formed by the spacer body 106 and the atomizing sieve 50, but also by a gas introduction element 113 which radially surrounds the valve seat body 16 and which extends in the axial direction both upstream and downstream of the perforated spray disc 21. The gas introduction element 113 is distinguished particularly in that an annular gas supply of the fuel emerging from the at least one spray orifice 25 is guaranteed in the spacer body 106. In the exemplary embodiment illustrated in FIG. 28, this gas supply is such that, via a gas connection 115, outside air, which, if appropriate, is heated by waste heat from the internal combustion engine or by active heating, or exhaust gas flows into an upper annular gas distributor 116, passes through from there via an axially extending narrow flow duct 117 in parallel with the valve longitudinal axis 2 into a second lower annular gas distributor 118 which is located, for example, downstream of the perforated spray disc 21 and from where the gas enters (gas introduction) the spacer body 106 via, for example, obliquely extending radial bores 119. The two gas distributors 116 and 118 are in this case provided only optionally. In this version of the test setup, the gas introduction element 113 possesses two internal threads, into which the injection valve, by means of an external thread provided on the nozzle body 108, is screwed from one side and the spacer body 106 is screwed from the other side, so that the gas introduction element 113 also serves as a connecting element in the injection valve and spacer body 106.

By means of the metering injection valve, the fuel is injected into the spacer body 106 as a pencil-shaped jet (jet angle $\geqq 10°$). This sleeve-shaped spacer body 106 is dimensioned (length, diameter) in such a way that the inner wall 110 is not directly wetted by the fuel jet. Gas is introduced from the lower gas distributor 118 either through the radial bores 119 or through small tubes or diaphragms, not shown, into the spacer body 106, in such a way that a specific and stable gas flow is obtained.

Some of the gas can also be placed into that part of the spacer body 106 facing the atomizing sieve 50 and located on the suction-pipe side, for example by means of a double-walled feature, not shown here, of the spacer body 106, in such a way that the gas acts in the form of a surrounding by gas which improves the atomization of the fuel (reduction of the droplet size). The fuel jet bordered by the gas flow in the spacer body 106 is atomized when it strikes the atomizing sieve 50. The gas flowing through the atomizing sieve 50 carries with it remaining fuel droplets (blowing free of the atomizing sieve 50) and thus leads to a clearly improved discharge and treatment behavior, particularly at low suction-pipe pressures. By means of an appropriately designed gas supply, the fuel jet can additionally be shaped upstream and downstream of the treatment by the atomizing sieve 50 (for example, elliptic jet pattern, asymmetric quantity distribution).

For the optimum guidance of the gas, emerging from the radial bores 119, in the spacer body 106, there can optionally be provided a gas guide insert 120 which, by means of an axially extending sleeve 122, serves for flow deflection and for the axial flow-off of the gas. The axial sleeve 122 of the gas guide insert 120 merges at its upstream end, for example, into a radially extending edge region 123 which is pressed at least partially by the spacer body 106 against the perforated spray disc 21, with the result that a slipping of the gas guide insert 120 is ruled out. The gas guide insert 120 is dimensioned in its length and diameter in such a way that, on the one hand, no wetting of the inner wall 110 by the fuel emerging from the perforated spray disc 21 can occur and, on the other hand, the gas flowing in through the radial bores 119 is guided. In contrast to the exemplary embodiments according to the present invention illustrated in FIGS. 24 to 27, the atomizing sieve 50 can be fastened, for example by adhesive bonding, welding or interlocking, to the spacer body 106 in an outer recess 125 at the lower end of the latter or can be cast on together with said spacer body 106.

By means of the gas introduction element 113 shown in FIG. 28, it is possible to arrange the atomizing sieve 50 at a distance of clearly more than 50 mm (for example, up to 100 mm) from the perforated spray disc 21 and nevertheless to achieve the same positive effects as in the injection valve of FIG. 24. The fuel jet is not braked or is braked to a lesser extent as a result of the gas flow. The consequently higher kinetic energy results in better atomization. If hot gas is used, for example exhaust gas, air heated by waste heat from the internal combustion engine or gas heated by means of additional electrical heating, a heating of the atomizing sieve 50, of the wall 110 of the spacer body 106 and of the fuel jet occurs. The evaporation of the fuel initiated thereby affords an additional improvement in the treatment.

All the exemplary embodiments according to the present invention subsequent to FIG. 28 are variations, modifications or improvements of the injection valves illustrated in FIGS. 24 to 28 and having atomizer attachments 105. The functional principles described with reference to FIGS. 24 to 28 are essentially maintained. There is therefore no need for a detailed description of the injection valves and of the spacer bodies 106 at this juncture. The decisive feature in all the further exemplary embodiments is the separation of the metering and treatment of the fuel which is achieved by means of the atomizer attachment 105 including the spacer body 106 and the atomizing sieve 50. The various arrangements can be provided both with and without gas introduction. In addition, jet-forming elements, such as, for example, jet dividers 68, are also included. As a result, particularly in four-valve engines, the distribution of the fuel can be adapted to the predetermined suction-pipe geometry.

Figure 29:
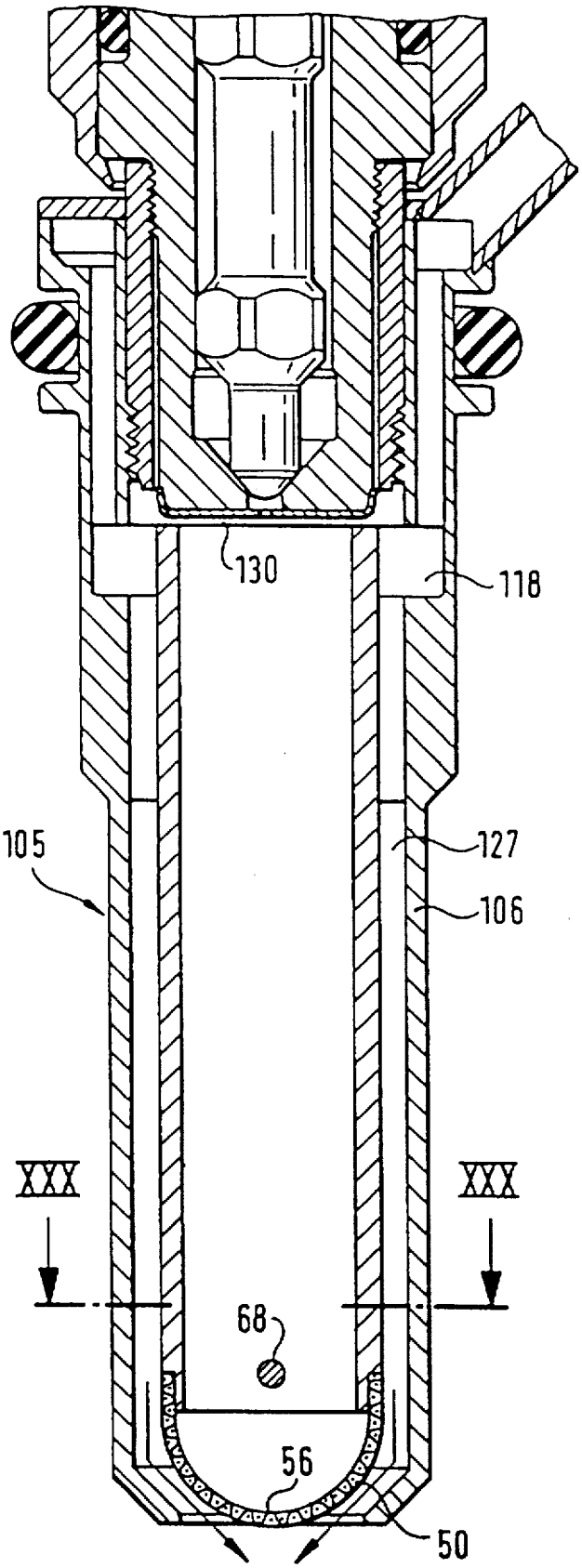
FIG. 29 shows a third example of a spacer body attached to a fuel injection valve having an atomizing sieve according to the present invention.
Figure 30:
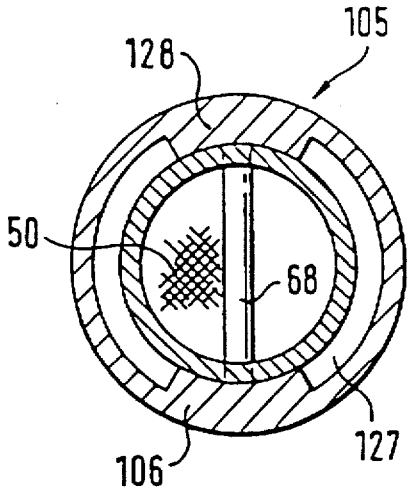
FIG. 30 shows a section along line XXX—XXX shown in FIG. 29.

The atomizer attachment 105 of the exemplary embodiment shown in FIG. 29 is distinguished particularly in that the spacer body 106 is made double-walled. Between the inner and the outer wall of the spacer body 106 there are, for example, two semicircular, axially elongate interspaces 127 which extend as far as the atomizing sieve 50 and which ensure a surrounding of the fuel by gas directly downstream of the atomizing sieve 50 by means of emerging gas, so that a further reduction in droplet size and therefore improved atomization are achieved. In a similar way to the separating web 68a in FIG. 9, inside the spacer body 106 a jet divider 68 extending transversely through the latter and having, for example, a circular cross section is arranged upstream of the lowest region 56 of the atomizing sieve 50. The jet divider 68 having the already often described function of breaking up the fuel into different directions can also possess other cross sections not shown. FIG. 30 is a sectional representation along the line XXX—XXX in FIG. 29 and illustrates the run of the jet divider 68 which is fastened, for example, in the regions 128 of the spacer body 106 which are formed between the interspaces 127. Finally, the jet forms of the fuel can be influenced by varying the dimensions (arc length, width) of the interspaces 127.

In addition to the surrounding by gas of the atomizing sieve 50, there is likewise provided a gas introduction which serves for the already explained improvement in the discharge behavior of the fuel. The atomizer attachment 105 is designed in such a way that the inner of the wall of the spacer body 106 does not reach directly up to the perforated spray disc 21, but on the contrary forms a specific annular inflow gap 130 between itself and the perforated spray disc 21. The gas can flow out of the lower gas distributor 118 both axially into the interspaces 127 and largely radially into the annular inflow gap 130 directly downstream of the perforated spray disc 21. Finally, the gas flowing through the annular inflow gap 130 also represents some surrounding of the fuel by gas which, however, takes effect only within the sleeve-shaped spacer body 106 and is present in addition to the surrounding by gas at the atomizing sieve 50.

The exemplary embodiment in FIGS. 31 and 32 differs therefrom in that, instead of the double-walled feature of the spacer body 106 and the interspaces 127 thereby formed, for the surrounding by gas an elongate gas tube 131 having essentially the length of the spacer body 106 is provided directly on the inner wall 110. Starting from the gas distributor 118, the gas introduction once again takes place via the annular inflow gap 130 directly into the sleeve of the spacer body 106, while the surrounding by gas at the atomizing sieve 50 is made possible by first forming, from the gas distributor 118, two part tubes 131' which extend at an inclination to the valve longitudinal axis 2 and which join to form the gas tube 131 extending axially as far as the atomizing sieve 50. FIG. 32, as a section along the line XXXII—XXXII in FIG. 31, illustrates the run of the gas tube 131 near the atomizing sieve 50. At the end facing away from the part tubes 131', the gas tube 131 is made U-shaped. It extends into the lowest region 56 of the camber 51 and arcuately on the opposite side upwards to a slight extent axially in the direction of the perforated spray disc 21. This end region 132 of the gas tube 131 is closed and has an axial length which corresponds to the axial extension of a blade-like flat jet divider 68 extending transversely through the camber 51 of the atomizing sieve 50. In its lowest region 134, the gas tube 131 has outflow orifices 135 for the gas. The gas tube 131 is embedded in a particular way in the jet divider 68 in the region of the camber 51 of the atomizing sieve 50. The fuel divided by the jet divider 68 and treated inter alia by the atomizing sieve 50 is struck directly downstream of the atomizing sieve 50 by the gas emerging from the gas tube 131 and is atomized particularly finely into very small droplets. Moreover, the gas has the effect of further driving apart the two jets predetermined by the jet divider 68.

FIGS. 33 and 34 illustrate an only slightly modified exemplary embodiment. In this, the gas tube 131 likewise extends axially along the inner wall 110, for example as far as the start of the atomizing sieve 50, and then, in a manner bent, for example, at right angles, transversely through the spacer body 106 as far as the opposite side of the spacer body 106. The end region 132 of the gas tube 131 is thus made respectively horizontal and perpendicular to the valve longitudinal axis 2, specifically directly in the form of a jet divider 68. The gas tube 131 otherwise shaped, for example, with a circular cross section therefore possesses, in its end region 132, a triangular cross section which allows jet division. On the lower side facing away from the perforated spray disc 21, the end region 132 is once again designed in such a way that gas can flow out downstream via outflow orifices 135. In this case, the gas already coming into contact with the fuel upstream of the atomizing sieve 50 serves more for improving the discharge behavior of the fuel than for reducing the droplet size of the fuel.

Figure 35:
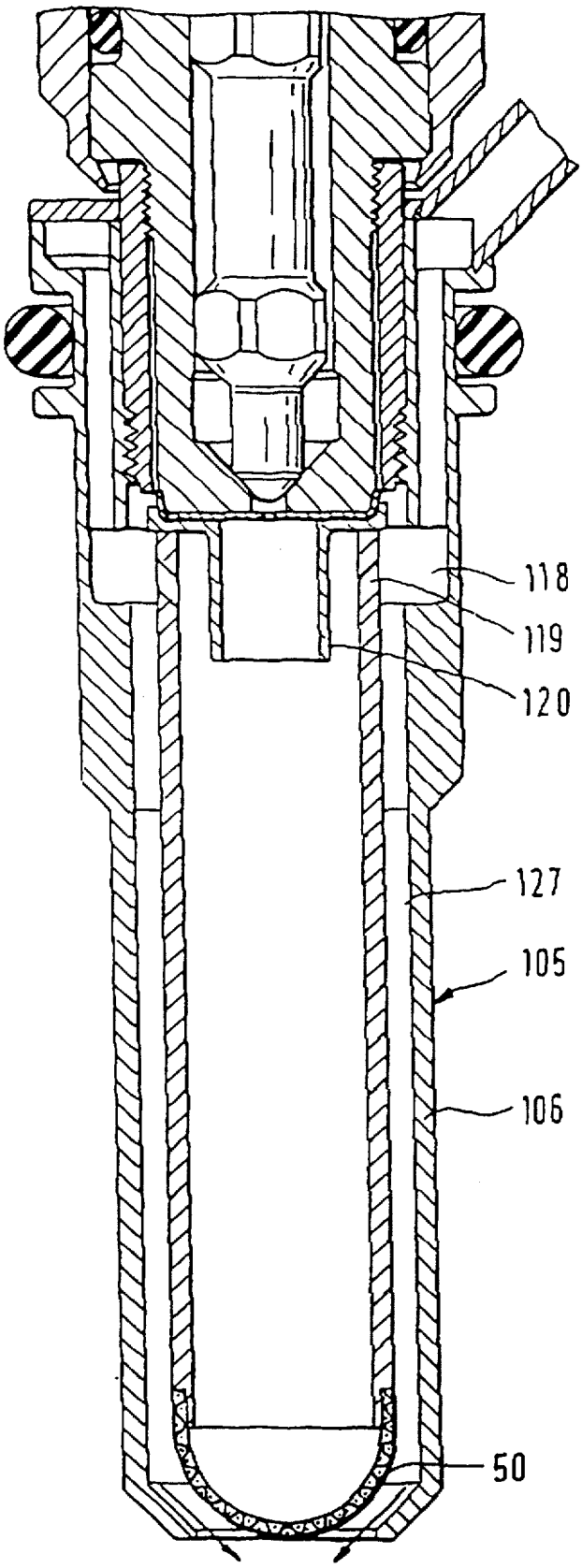
FIG. 35 shows a sixth example of a spacer body attached to a fuel injection valve having an atomizing sieve according to the present invention.
Figure 36:
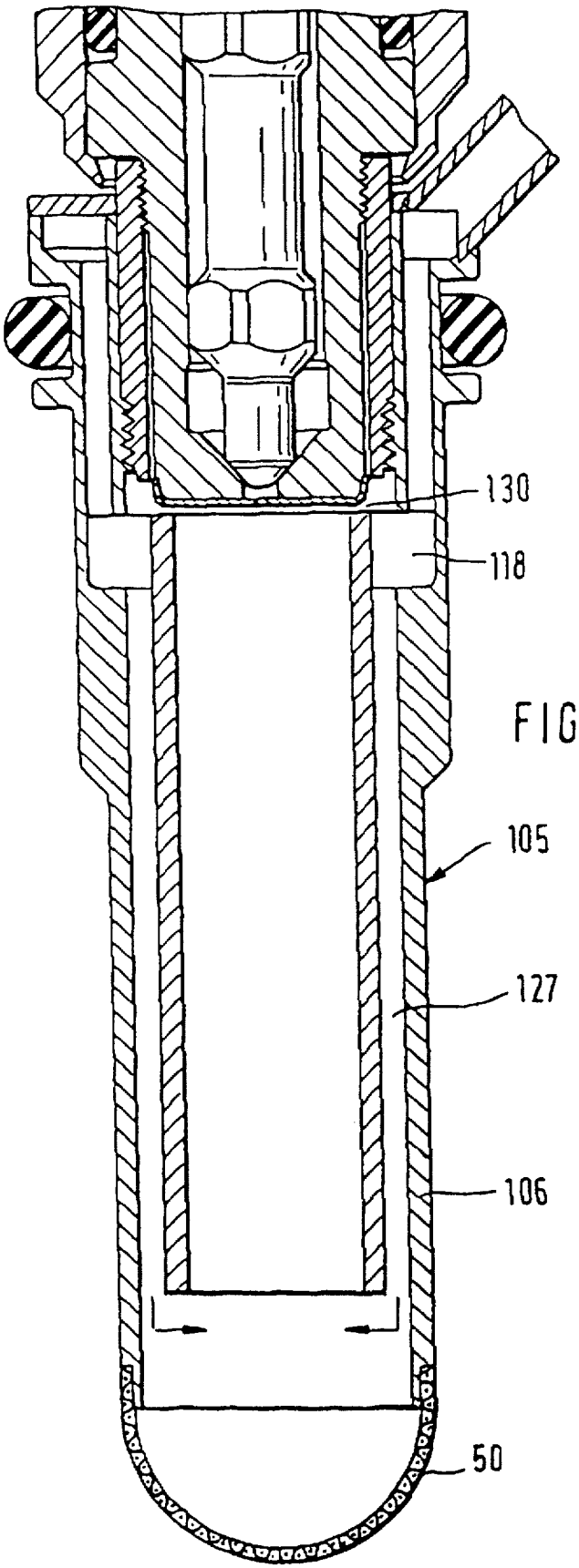
FIG. 36 shows a seventh example of a spacer body attached to a fuel injection valve having an atomizing sieve according to the present invention.

The exemplary embodiment according to the present invention, shown in FIG. 35, of a valve with spacer body 106 and atomizing sieve 50 corresponds largely to the valve shown in FIG. 29. This FIG. 35 is intended merely to illustrate what diversity of alternatives is possible by the addition or omission of individual small modules on the atomizer attachment 105. Only the differences in relation to FIG. 29 are therefore mentioned below. The gas introduction takes place via the radial bores 119 as connections of the lower gas distributor 118 and the interior of the spacer body 106. No annular inflow gap 130 is provided in the region of the perforated spray disc 21, but instead, for example as a result of the installation of the gas guide insert 120, the atomizer attachment 105 bears sealingly on the perforated spray disc 21. Moreover, gas flows from the gas distributor 118 axially between the two walls of the spacer body 106 in the direction of the atomizing sieve 50. This arrangement can be designed both with or without a jet divider In the atomizer attachment 105 illustrated in FIG. 36, in exactly the same way as in FIG. 29, two different gas flows extending approximately over the length of the spacer body 106 are provided. Starting once again from the gas distributor 118, part of the gas flows via the annular inflow gap 130 into the interior of the spacer body 116 directly at the perforated spray disc 21, and another part flows via the, for example, two interspaces 127 which are formed by the double-walled feature. However, the interspaces 127 already terminate upstream of the atomizing sieve 50. This is possible particularly in that, this time, the atomizing sieve 50 is fastened to the outer wall of the spacer body 106. The gas still flowing upstream of the atomizing sieve 50 out of the interspaces 127 into the spacer body 106 has a different velocity from the gas flowing inside the spacer body 106, so that, when they meet one another, swirling also occurs as a result of the different direction of flow. Particularly when no jet division is desired, this solution is appropriate for improving the atomization of the fuel.

Figure 37:
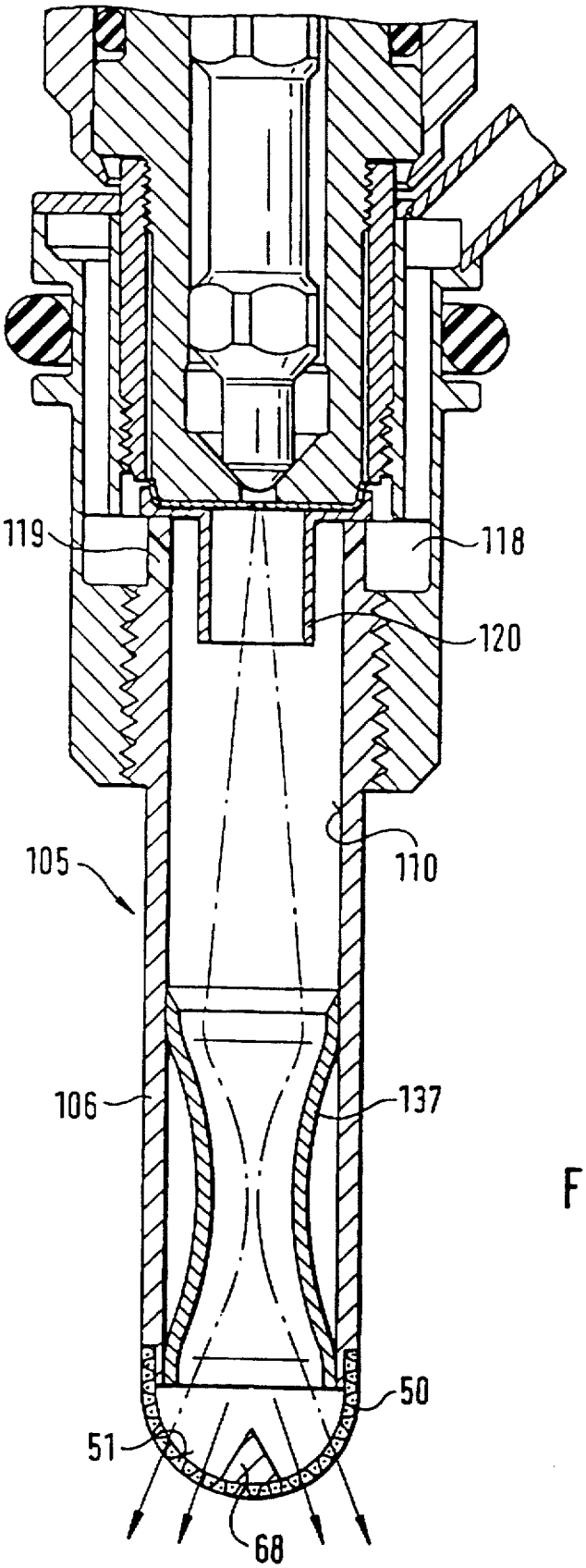
FIG. 37 shows an eighth example of a spacer body with a Venturi tube attached to a fuel injection valve having an atomizing sieve according to the present invention.

In the exemplary embodiment in FIG. 37 too, the known radial bores 119 in the wall of the spacer body 106 and the gas guide insert 120 guarantee that no wetting of the inner wall 110 takes place over a large part of the spacer body 106. A Venturi tube 137 is provided in the downstream end of the spacer body 106 facing the atomizing sieve 50. The function of the Venturi tube 137 is to ensure a very good intermixing of fuel and gas even before the atomization and treatment of the fuel at the atomizing sieve 50. This fuel/gas mixture accelerated in Venturi tube 137 increases the treatment quality of the fuel. The, for example, conical or pyramidal jet divider 68 in the camber 51 of the atomizing sieve 50 can be arranged optionally.

Figure 38:
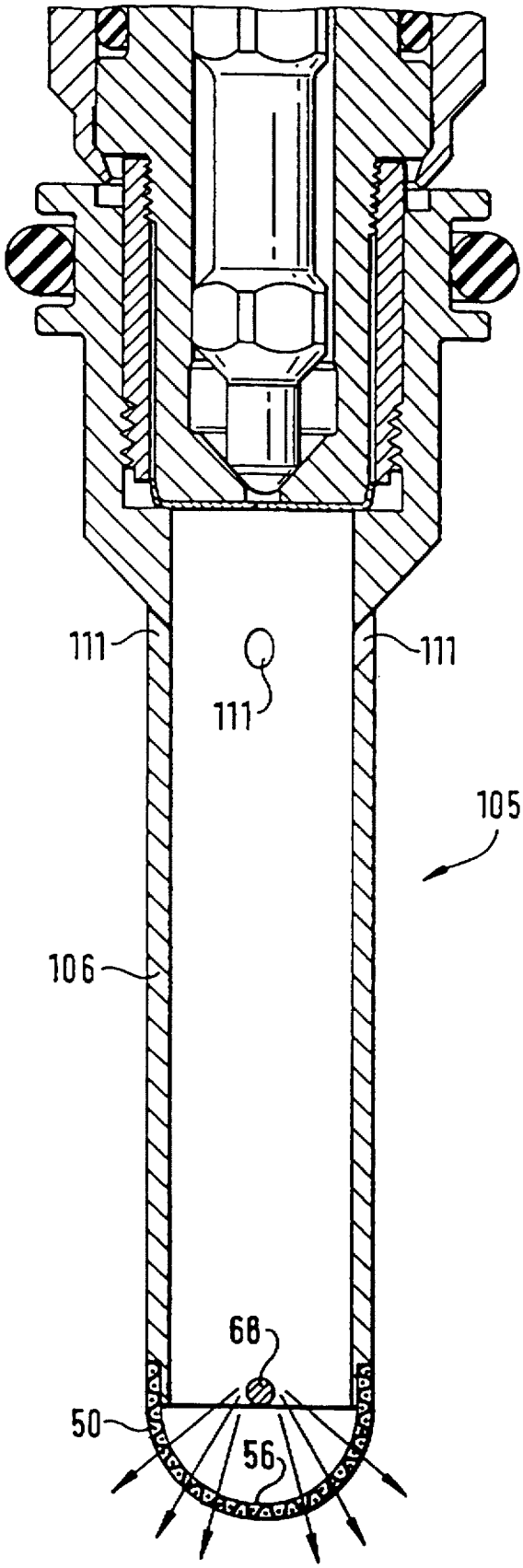
FIG. 38 shows a ninth example of a spacer body attached to a fuel injection valve having an atomizing sieve according to the present invention.

FIG. 38 shows a very simple embodiment of the atomizer attachment 105. The essential features of this exemplary embodiment are, in summary: no gas introduction, but only suction of suction-pipe air on the principle of the water-jet pump through the orifices 111 and consequently pressure equalization with the environment and the avoidance of wall wetting in the spacer body 106; and the jet divider 68 extending transversely in a web-like manner through the spacer body 106, for example at the end of the latter facing the atomizing sieve 50.

Figure 39:
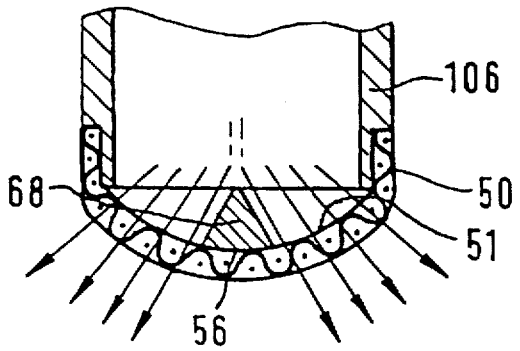
FIG. 39 shows an only slightly cambered atomizing sieve according to the present invention.
Figure 40:
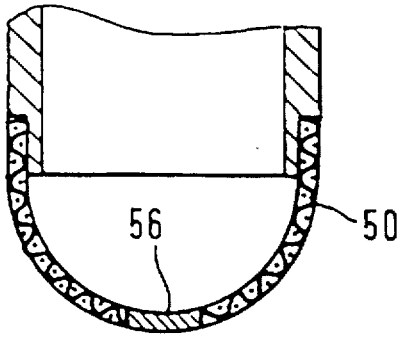
FIG. 40 shows a two-part atomizing sieve according to the present invention.
Figure 41:
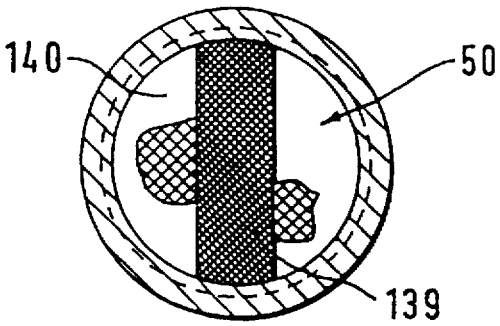
FIG. 41 shows an atomizing sieve with a partial change of the mesh width according to the present invention.

FIGS. 39, 40 and 41 show some conceivable alternatives of atomizing sieves 50 which differ from the dish-like atomizing sieves 50 described previously in connection with the atomizer attachments 105 and having a uniform mesh width. The atomizing sieve 50 illustrated in FIG. 39 is distinguished by a camber 51 not having a constant radius. The camber 51 is now made substantially flatter. The jet divider 68 possessing, for example, a sharp blade is worked directly into the atomizing sieve 50, for example in its lowest region 56. FIG. 40 shows an example of a two-part atomizing sieve 50, in which a different sieve material is used, for example, in the lowest region 56 from that in the rest of the camber 51. The multi-part atomizing sieve 50 can be produced very simply in one operation by the injection molding of the various sieve parts. FIG. 41 illustrates a top view of an atomizing sieve 50 with a partial change of the mesh width, for example the same sieve material being used throughout. Here, the atomizing sieve 50 has a middle web-like sieve region 139 which extends, for example, through the entire camber 51 in a narrow strip.

This inner sieve region 139 is surrounded on both sides by outer sieve regions 140, so that the atomizing sieve 50 is formed from three segments. It is especially advantageous to design the inner sieve region 139 with a coarser mesh than the outer sieve regions 140. Some forming of the fuel jet can already be achieved solely by the use of different mesh widths in the atomizing sieve 50 and a resulting different atomization behavior. Moreover, the variation in the mesh width proves beneficial if boiling residues of the fuel are to be retained on the atomizing sieve 50 in the light of the plugging problem already discussed. These settlements can, for example, be bound very easily in the fine-mesh outer sieve regions 140, while the middle sieve region 139 remains free.

Figure 42:
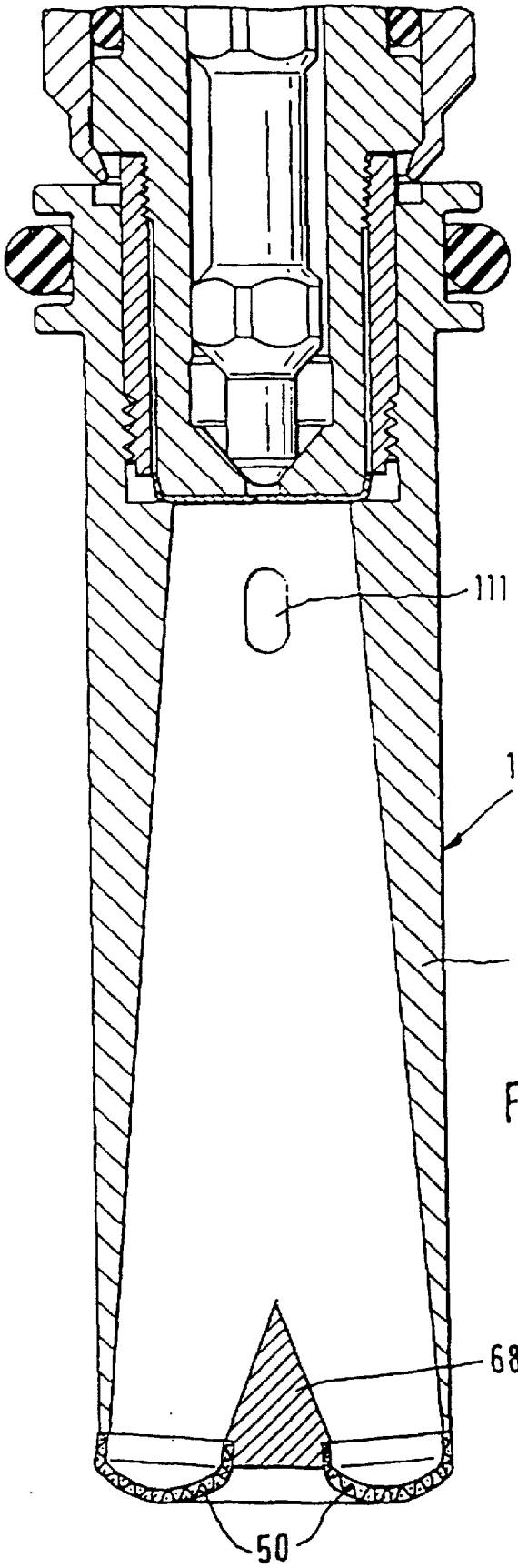
FIG. 42 shows a tenth example of a spacer body attached to a fuel injection valve having two atomizing sieves according to the present invention.
Figure 43:
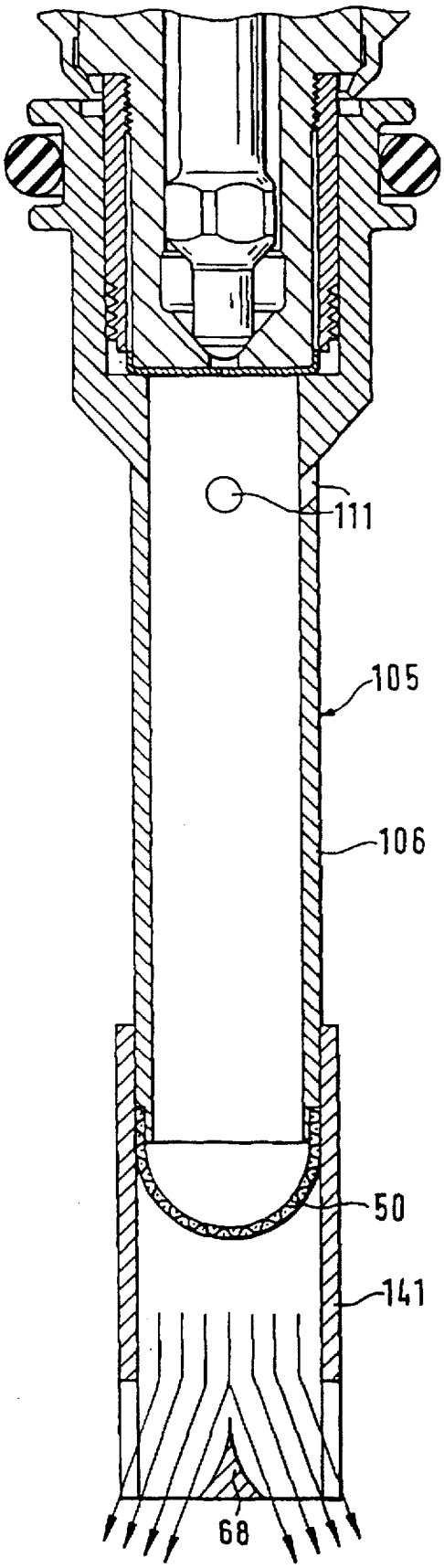
FIG. 43 shows an eleventh example of a spacer body attached to a fuel injection valve having an atomizing sieve according to the present invention.

FIGS. 42 and 43 show two further special cases of a desired jet division of the fuel. For injection to, for example, two inlet valves of the internal combustion engine, it is appropriate to use two separate dish-like atomizing sieves 50 (FIG. 42) which are fastened directly to the downstream end of the spacer body 106 and which are separated from one another by the jet divider 68. The jet divider 68 projects directly from the wall of the spacer body 106 and thereby also affords the necessary stability in the region of the atomizing sieves 50. In addition to the spacer body 106, in the exemplary embodiment in FIG. 43 a sleeve-shaped jet-dividing element 141 extending mainly downstream of the atomizing sieve 50 and firmly connected to the spacer body 106 is arranged. The jet-dividing element 141 once again has, at its downstream end, the actual, for example, blade-like jet divider 68 which is therefore at a clear distance from the atomizing sieve 50. The length of the jet-dividing element 141 can be made variable according to the conditions of installation and to the geometry of the suction pipe and can thus be optimally adapted. The jet divider 68 located downstream of the atomizing sieve 50 shows that the already atomized and treated fuel spray is sprayed in different directions (for example, to two inlet valves). This arrangement can be combined at any time with a gas introduction.

Figure 44:
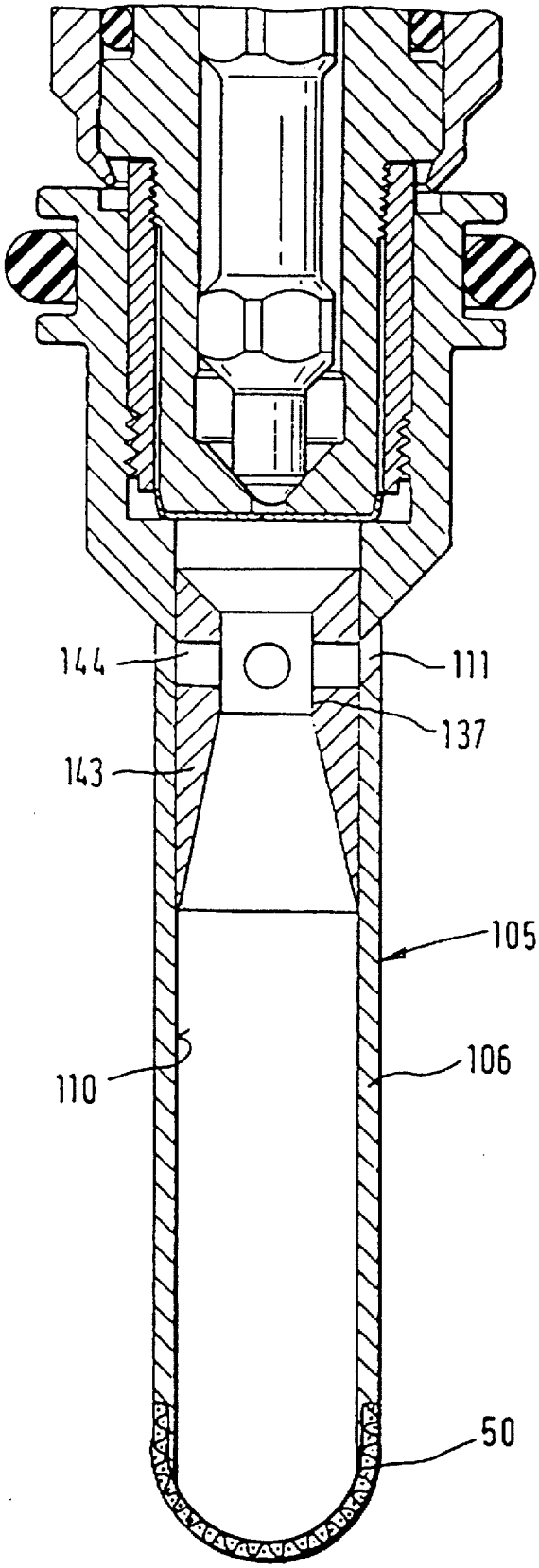
FIG. 44 shows a twelfth example of a spacer body with a Venturi tube attached to a fuel injection valve having an atomizing sieve according to the present invention.

The valve shown in FIG. 44 having the atomizer attachment 105 is distinguished particularly by the Venturi tube 137 which is installed in the spacer body 106 and which is already known from FIG. 37. However, the Venturi tube 137 is now arranged in such a way that suction-pipe air sucked in according to the principle of the water-jet pump flows in directly via the orifices 111 at the narrowest point of the Venturi tube 137. A cylindrical tube insert body 143 containing the Venturi tube 137 has the same outside diameter as the diameter of the inner wall 110 of the spacer body 106. This tube insert body 143 is, for example, pressed in the spacer body 106. According to the number of orifices 111, for example the same number of transverse orifices 144 are provided in the tube insert body 143, by means of which transverse orifices direct connections from the orifices 111 to the narrowest cross section of the Venturi tube 137 are made. The formation of the orifices 111 in the spacer body 106 in the region of axial extension of the narrowest cross section of the Venturi tube 137 advantageously allows the greatest possible suction effect on the gas.

What is claimed is:

1. A fuel injection valve for supplying fuel to an internal combustion engine, the fuel injection valve having a longitudinal valve axis, comprising:

a valve seat;

a valve closing part cooperating with the valve seat;

a spray disc connected to the valve seat, the spray disc having at least one spray orifice; and an atomizing sieve disposed downstream of the at least one spray orifice, the atomizing sieve including a sieve leaf having an inner portion allowing the passage of fuel, the inner portion deviating from a plane leaf shape.

2. The fuel injection valve according to claim 1, wherein the inner portion includes a camber having a dish shape.

3. The fuel injection valve according to claim 2, wherein the inner portion includes at least two cambers, each of the at least two cambers having a dish shape.

4. The fuel injection valve according to claim 1, wherein the sieve leaf is composed of a rust-proof metal.

5. The fuel injection valve according to claim 4, wherein the rust-proof metal includes one of a plastic material, a TEFLON® material, a PTC material and silicon.

6. The fuel injection valve according to claim 1, wherein the inner portion includes a mesh, the mesh having a mesh width at least as great as 0.1 mm.

7. The fuel injection valve according to claim 1, wherein the inner portion has one of a single layer construction and a multi-layer construction.

8. The fuel injection valve according to claim 6, wherein the mesh has a variable mesh width.

9. The fuel injection valve according to claim 1, wherein the sieve leaf is composed of a bi-metal.

10. The fuel injection valve according to claim 1, wherein an outer portion of the sieve leaf is at least partially attached to a clamping ring, the clamping ring facilitating mounting of the atomizing sieve on the fuel injection valve.

11. The fuel injection valve according to claim 1, further comprising:

a valve seat carrier connected to the valve seat; and a protective cap mounted on a downstream end of the valve seat carrier, wherein an outer circumferential region of the sieve leaf is cast into the protective cap.

12. The fuel injection valve according to claim 1, wherein the sieve leaf includes at least one camber.

13. The fuel injection valve according to claim 12, wherein the sieve leaf includes two cambers, each of the cambers being arranged symmetrically to the longitudinal valve axis.

14. The fuel injection valve according to claim 13, wherein the sieve leaf includes two cambers, each of the cambers being arranged asymmetrically to the longitudinal valve axis.

15. The fuel injection valve according to claim 13, wherein the at least one camber is annular.

16. The fuel injection valve according to claim 1, wherein the atomizing sieve further includes a jet divider integrated on one of an upstream surface and a downstream surface of the sieve leaf.

17. The fuel injection valve according to claim 1, further comprising a jet divider disposed downstream of the atomizing sieve.

18. The fuel injection valve according to claim 1, wherein an annular gas gap is formed between the at least one spray orifice and the atomizing sieve so that the fuel emerging from the at least one spray orifice collides with a gas emerging from the annular gas gap, providing a fuel/gas mixture striking the atomizing sieve.

19. The fuel injection valve according to claim 1, further comprising a valve seat carrier connected to the valve seat and an insert part projecting at least partially into the valve seat carrier, wherein at least one supply duct is formed between the at least one spray orifice and the atomizing sieve in the insert part so that the fuel emerging from the at least one spray orifice collides with a gas emerging from the at least one supply duct, providing a fuel/gas mixture striking the atomizing sieve.

20. The fuel injection valve according to claim 1, further comprising:

a valve seat carrier connected to the valve seat and;

a protective cap mounted on a downstream end of the valve seat carrier, wherein at least one supply duct is formed in the protective cap so that the a gas emerging from the at least one supply duct strikes an outer surface of the sieve leaf facing away from the at least one spray orifice.

21. The fuel injection valve according to claim 20, wherein the at least one supply duct is formed so that an imaginary extension of the at least one supply duct is directed onto a lowest region of the outer surface of the sieve leaf.

22. The fuel injection valve according to claim 20, wherein the at least one supply duct is formed so that an imaginary extension of the at least one supply duct contacts the outer surface of the sieve leaf tangentially.

23. The fuel injection valve according to claim 1, wherein the atomizing sieve includes at least two atomizing sieves connected in series.

24. The fuel injection valve according to claim 1, further comprising a spacer body arranged between the at least one spray orifice and the atomizing sieve, the spacer body providing a spatial separation of a metering of fuel in a region of the at least one spray orifice and a treatment of fuel in a region of the atomizing sieve.

25. The fuel injection valve according to claim 24, wherein the spacer body and the atomizer sieve form an atomizer attachment.

26. The fuel injection valve according to claim 24, wherein the atomizing sieve is in a range of 5 to 100 mm from the at least one spray orifice.

27. The fuel injection valve according to claim 24, wherein the spacer body has a sleeve-shape and a side of the spacer body facing the at least one spray orifice includes at least one orifice for intaking a gas.

28. The fuel injection valve according to claim 24, wherein the spacer body has at least a partially double-walled construction, at least one interspace being formed between the walls of the double-walled construction of the spacer body, a gas being able to flow through the at least one interspace.

29. The fuel injection valve according to claim 24, wherein a jet divider is integrated in the spacer body.

30. The fuel injection valve according to claim 24, further comprising a gas tube extending essentially axially in the spacer body, the gas tube having a cross-section smaller than the spacer body and an outlet orifice adjacent to the atomizing sieve.

31. The fuel injection valve according to claim 24, further comprising a Venturi tube inside the spacer body, the Venturi tube having a cross-sectional reduction in relation to the spacer body.

32. The fuel injection valve according to claim 24, further comprising a gas guide insert inside the spacer body and downstream of the at least one spray orifice, the gas guide insert including at least one substantially axially extending flow-off face for a gas.

33. The fuel injection valve according to claim 24, wherein the spacer body includes an annular inflow gap for an inflow of gas, the annular inflow gap being formed downstream of the at least one spray orifice.

34. A fuel injection valve for supplying fuel to an internal combustion engine, the fuel injection valve having a longitudinal valve axis, comprising:

a valve seat;

a valve closing part cooperating with the valve seat;

a spray disc connected to the valve seat, the spray disc having at least one spray orifice;

an atomizing sieve disposed downstream of the at least one spray orifice, the atomizing sieve including a sieve leaf having an inner portion allowing the passage of fuel, the inner portion deviating from a plane leaf shape;

a valve seat carrier connected to the valve seat;

a protective cap mounted on a downstream end of the valve seat carrier; and a clamping ring attached at least partially to an outer portion of the sieve leaf, the clamping ring being gripped between the valve seat carrier and the protective cap.

35. The fuel injection valve according to claim 24, wherein the protective cap is formed as a protective crown having at least two protective prongs extending away from the fuel injection valve.

36. The fuel injection valve according to claim 35, wherein the at least two protective prongs extend below a lowest region of the atomizing sieve.

37. The fuel injection valve according to claim 34, wherein the atomizing sieve and the protective cap form an exchangeable treatment attachment.

* * * * *

UNITED STATES PATENT AND TRADEMARK OFFICE

CERTIFICATE OF CORRECTION

PATENT NO. : 5,707,012

DATED : January 13, 1998

INVENTOR(S) : Maier et al.

It is certified that error appears in the above-identified patent and that said Letters Patent is hereby corrected as shown below:

Column 1, line 56, delete "having the"

Column 1, line 65, after "say" insert --,--.

Column 2, line 28, after "example" insert--,--.

Column 9, line 27, after "including" delete --,--.

Column 19, line 49, change "byway," to --by way--.

Column 23, line 52, change "$\geqq$" to---$\leqq$--.

Column 26, line 35, change "divider" to --divider 68.--

Signed and Sealed this

Nineteenth Day of January, 1999

*Attest:*

*Attesting Officer*

*Acting Commissioner of Patents and Trademarks*